US005975641A

United States Patent [19]

Delesie

[11] Patent Number: 5,975,641

[45] Date of Patent: Nov. 2, 1999

[54] UNDULATORY MOTION RELAXATION DEVICE FOR FURNITURE WITH A SUSPENSION SYSTEM

[76] Inventor: Patrick Delesie, Pijkstraat 53, 8790 Waregem, Belgium

[21] Appl. No.: 08/973,030

[22] PCT Filed: Jun. 6, 1996

[86] PCT No.: PCT/BE96/00055

§ 371 Date: Mar. 25, 1998

§ 102(e) Date: Mar. 25, 1998

[87] PCT Pub. No.: WO96/39067

PCT Pub. Date: Dec. 12, 1996

[30] Foreign Application Priority Data

Jun. 6, 1995 [BE] Belgium ..... 9500497
Sep. 7, 1995 [BE] Belgium ..... 9500742

[51] Int. Cl.[6] ..... A47C 7/02

[52] U.S. Cl. ..... 297/452.63; 297/284.3

[58] Field of Search ..... 297/452.63, 284.1, 297/284.3

[56] References Cited

U.S. PATENT DOCUMENTS

| | | | |
|---|---|---|---|
| 3,565,482 | 2/1971 | Blodee | 297/452.63 X |
| 3,632,170 | 1/1972 | Witt | 297/452.63 |
| 3,874,730 | 4/1975 | Marchello | 297/452.63 |
| 3,877,750 | 4/1975 | Scholpp | 297/284.3 |
| 4,176,880 | 12/1979 | Marchello | 297/452.63 |
| 4,192,547 | 3/1980 | Geir | 297/452.63 |
| 4,730,872 | 3/1988 | Golzer | 297/452.63 |
| 5,335,975 | 8/1994 | Krouskop et al. | 297/452.63 |

FOREIGN PATENT DOCUMENTS

| | | | |
|---|---|---|---|
| A 781 040 | 7/1972 | Belgium . | |
| A 2 662 063 | 11/1991 | France . | |
| 85/00276 | 1/1985 | WIPO | 297/284.3 |

*Primary Examiner*—Peter M. Cuomo
*Assistant Examiner*—Rodney B. White
*Attorney, Agent, or Firm*—Sughrue, Mion, Zinn Macpeak & Seas, PLLC

[57] ABSTRACT

A relaxation device for furniture, particularly for an armchair of relaxing chair, includes body support flats (11, 12, 13; 101; 201) which are each formed of interconnected elongated support members (3) extending parallel to each other and transversally to a longitudinal axis of the device (Z), a frame (2) and means (23, 43) for coupling the above support flats (11, 12, 13; 101, 201) to the frame (2), characterized in that each set of elongated support members (3) is mounted by means of a multiple action suspension system (S1, S2) which is formed of a first stage suspension unit wherein each pair of adjacent elongated support members (3', 3") is externally coupled by means of primary intermediate suspension parts (31), and at least one additional second stage suspension unit wherein each pair of adjacent primary intermediate suspension parts (31', 31") is externally coupled by secondary suspension parts (33; 32', 32") which are directly (23) or indirectly (23, 33, 24) connected to the frame (2), so that the elongated support members (3) are mutually movable in two modes and can move from an unloaded state (A) to a loaded state (B) with the superimposed undulatory motion of said members (3).

14 Claims, 23 Drawing Sheets

FIG. 30
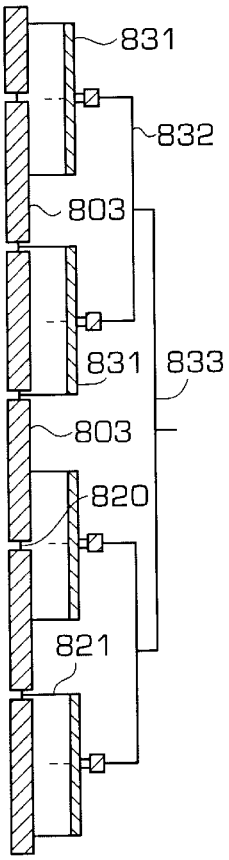
FIG. 29
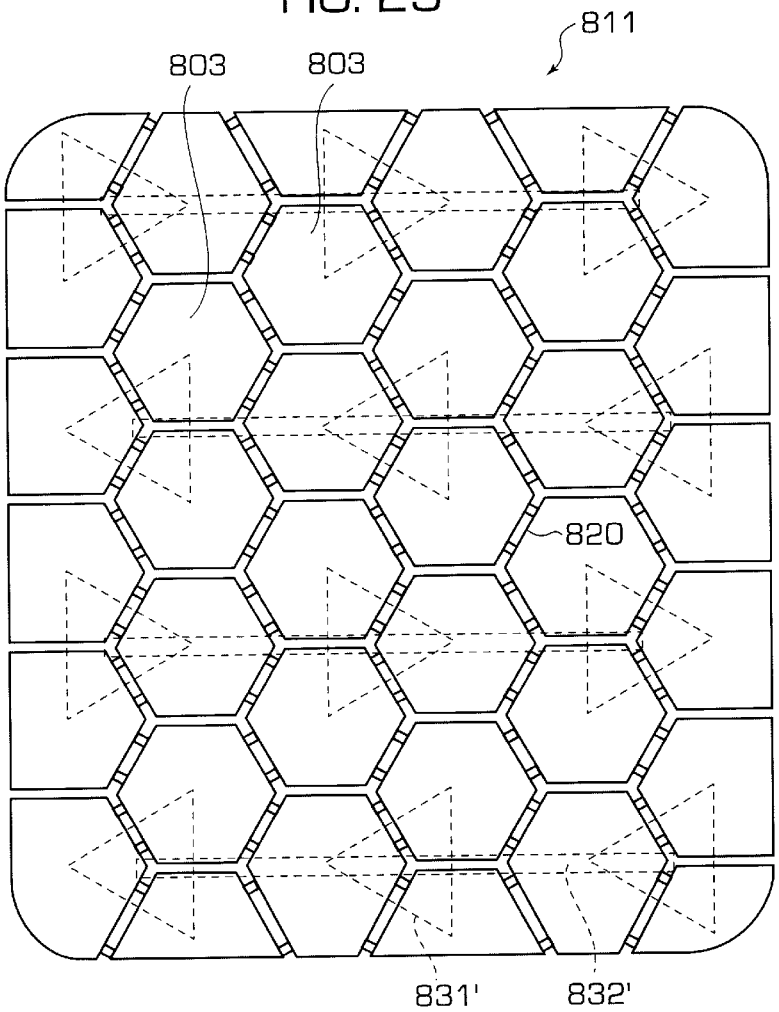
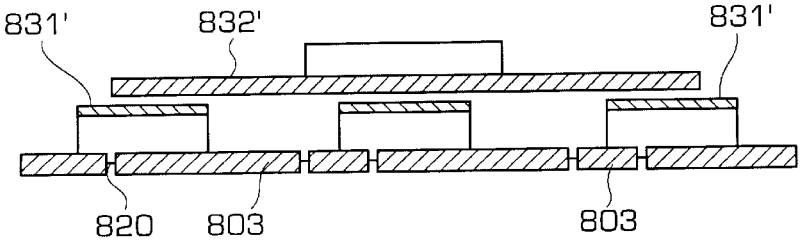
FIG. 31

UNDULATORY MOTION RELAXATION DEVICE FOR FURNITURE WITH A SUSPENSION SYSTEM

FIELD OF THE INVENTION

The present invention relates to a furniture device for body support, in particular seat or relaxing furniture, comprising body support flats which each consist of elongate supporting elements coupled to one another, arranged in parallel and oriented transversely relative to a longitudinal axis of the device, a frame and coupling means for coupling the abovementioned support flats to the abovementioned frame.

TECHNICAL BACKGROUND

Sitting down or lying down ought to have a relaxing effect. The leg muscles can relax, since they do not have to carry any weight in this position. By contrast, the back muscles could relax, provided that they are not put under stress when the user adopts the desired posture.

When sitting on a seat, only a small part of the back is in actual contact with the back of the seat. The back muscles are continually tensed in order to keep the back in the desired position, so as thereby to compensate for the lack of suitable support provided by the seat back.

By contrast, when sitting in a more upholstered seat, the cushion admittedly assumes the shape of the back. However, the more pressed-in parts of the cushion exert higher pressure on the back than the less pressed-in parts, particularly level with the lumbar region. There is, once again, the same problem that the back muscles are under stress, and the user begins to wriggle about and tries to shift his sitting plane further and further forwards by sinking further and further into the chair until the lower back is once more completely unsupported.

The cause of this restlessness is not only the unequal support which the back receives, but also a need for movement. There is therefore clearly a problem as regards the user's comfort.

Being seated for a long time and standing for a long time both represent a heavy physical load. The body needs to move in order to remain supple.

A good seat back and a good seat therefore ought to assume the shape of the sitter's back and bottom and thereby provide uniform support on all the exposed parts of the body. This characteristic should be maintained when the user moves and adopts different postures.

PRIOR ART

Comfort devices of the abovementioned type are already known. Thus, existing beds are concerned, however, with lath systems which must support a mattress or which, in more general terms, require a soft intermediate layer. Most of the existing systems, with the exception of that of Milton Luchenski (United States of America) and of J. M. Reau (France), comprise laths resting on supports which move to-and-fro in a guide element. The laths all pivot on the supports. The movement of the supports is only one-dimensional.

Moreover, in all these known systems, the laths are in mutually independent movement. In order to follow the undulatory movement of the body, which has as it were a series of bumps and hollows, the laths pivot in a particular direction, either under the pressure of the mattress or by means of an elastic material to which they are connected. The result of this is a lack of flexibility for existing furniture.

There are also spring-suspension systems which, however, have the serious disadvantage of high exposure to wear. Moreover, in the case of interdependent springs acting directly on one another, a malfunction of one of them may bring about a malfunction of the entire system.

SUMMARY OF THE INVENTION

The object of the present invention is to overcome the abovementioned problems. To this purpose there is proposed a device as defined in claim 1. Thus, by means of the comfort device according to the invention, the support flat of the device assumes the shape of the body when it comes into contact with the latter, and, more specifically, when the user takes up position on or against the abovementioned support flat. The support flat continuously follows the movement of the body, and excellent distribution of the pressure on the body is obtained. Furthermore, the movement of the intermediate suspension parts must be considered as being in two modes, in that a superposition of undulatory movements on different levels is achieved, so that the supporting elements execute a superposed undulatory movement which accurately matches that of the body.

According to an advantageous embodiment of the invention, the successive elongate supporting elements are each connected directly to one another along their longitudinal sides by suitable connection means. This results in a completely continuous support-flat surface, this being beneficial to the user's comfort. More particularly, the abovementioned direct-connection means are formed by hinge-type articulated connections. These means are particularly suitable for the suspension systems employed in the device according to the invention, thus increasing the user's comfort even further. According to a likewise advantageous embodiment of the invention, the same applies to the intermediate suspension parts forming the suspension system.

In a particularly advantageous embodiment of the invention, the overlapped arrangement, which is preferred for the intermediate suspension parts with respect to the corresponding pairs of elongate supporting elements, is carried out in a plane substantially common to the abovementioned elongate elements, on the one hand, and to the corresponding primary intermediate part, on the other hand. Moreover, the all-direction arrangement in a single plane has a considerable advantage with regard to seats, inasmuch as a change is made from an equilibrium of the unstable type to an equilibrium of the neutral type.

By virtue of the hierarchical structure of the elements as a whole as defined in claim 2, whether they be actual supporting elements or suspension elements, perfect co-ordination of the system as a whole is obtained, additionally with effective and interdependent superposition of the elements of different levels which simulates the superposition of undulations of different order.

In a more particularly advantageous embodiment of the invention, the connecting elements are elongate and are arranged transversely relative to the elongate supporting elements and in substantially the same plane as the latter, and laterally relative to these, so as to be themselves capable of serving as supporting elements, but in the lateral direction. This particular feature could prove especially useful in the case of a seat. In fact, in this arrangement of lateral connecting elements of the same type as the lath-like supporting elements, according to a preferred embodiment of the invention, these connecting elements could serve, in particular, as armrests. In a more particular embodiment of the invention, the lath contour narrows from one end to the other. This variation in the overall lath contour may be put to highly advantageous use in order to take into account the structure of the body, the narrowed end parts of each support flat being arranged so as to correspond to the respective ends of the body.

In a highly advantageous embodiment of the invention, both the supporting elements and the connecting elements or intermediate parts of each abovementioned hierarchical level are of substantially uniform shape. This makes it possible to achieve optimization of effective comfort surface for the user, whilst at the same time ensuring minimal overall size due to the absence of elements in additional planes of arrangement.

In an extremely advantageous embodiment according to the invention, all the abovementioned means of articulation, both those articulating the abovementioned intermediate parts to one another and those connecting the latter to the abovementioned elongate supporting elements, consist of shafts which are all oriented in the direction of the longitudinal axis of the elongate supporting element. This allows the elongate supporting elements to be oriented by pivoting on their longitudinal axis if these are subjected to stress by the load of a user's body. This results in a structure which, although having very great simplicity, nevertheless affords all the advantages of a hierarchical suspension device, with undulatory movements being superposed by hierarchical level.

In an alternative embodiment of the invention, the abovementioned direct-connection means are formed by a flexible element. Other particular features and advantages of this alternative embodiment are defined in the corresponding subclaims.

Other advantages and particular features of the present invention in general will be described below by means of the description of some exemplary embodiments of the comfort device according to the invention which are illustrated by means of the accompanying drawings.

BRIEF DESCRIPTION OF THE FIGURES

FIGS. 29 to 33 show another category of comfort device according to the invention.

DESCRIPTION OF THE INVENTION

In general terms, the present invention relates to comfort devices of all types, such as armchairs, beds, and other uses, in which a comfort interface acting as a buffer between part of the human body and an external element which may itself form the load or, on the contrary, in which it is the body which forms the load. However, in the examples described below, the description will be aimed more at armchairs for the sake of convenience and clarity.

Figure 1:
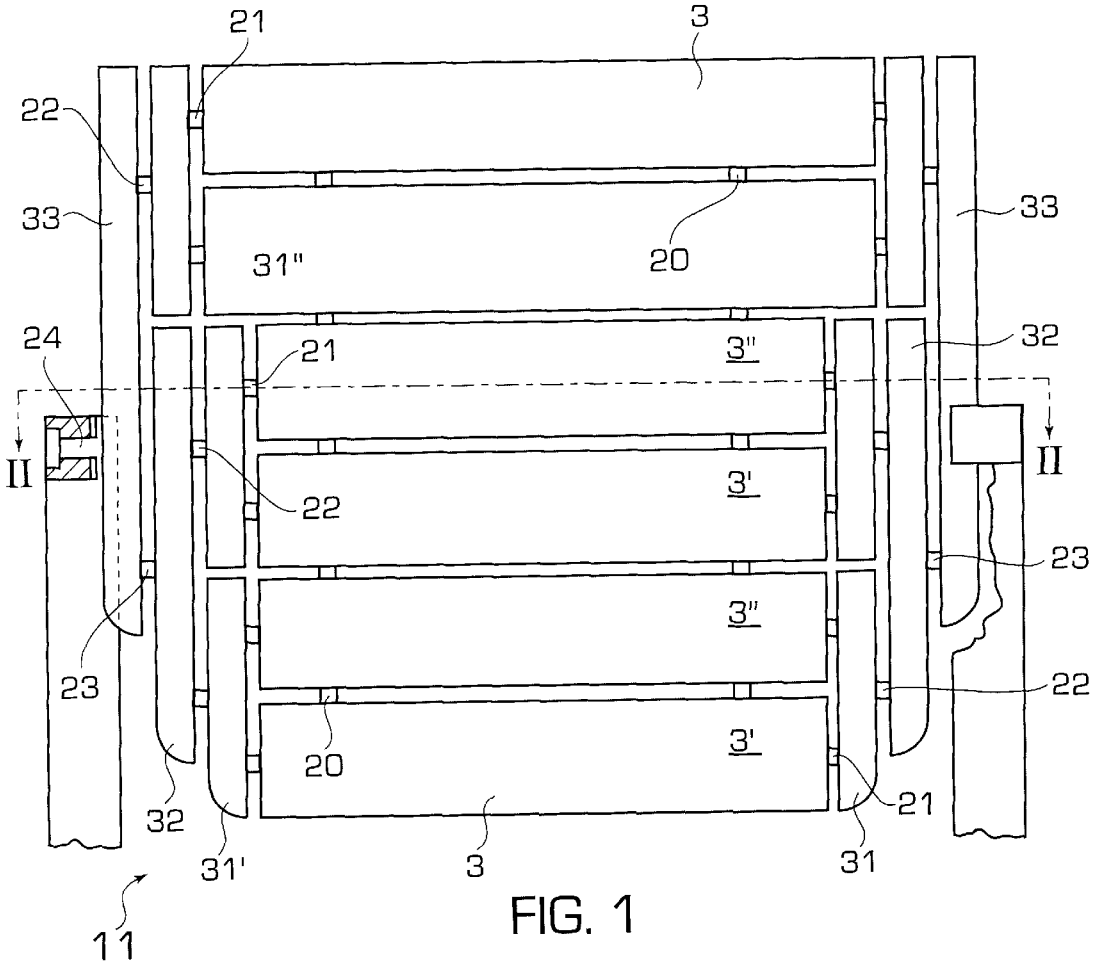
FIGS. 1 and 2 show a partial view in plan and respectively in section of a first embodiment of a comfort device according to the invention.
Figure 9:
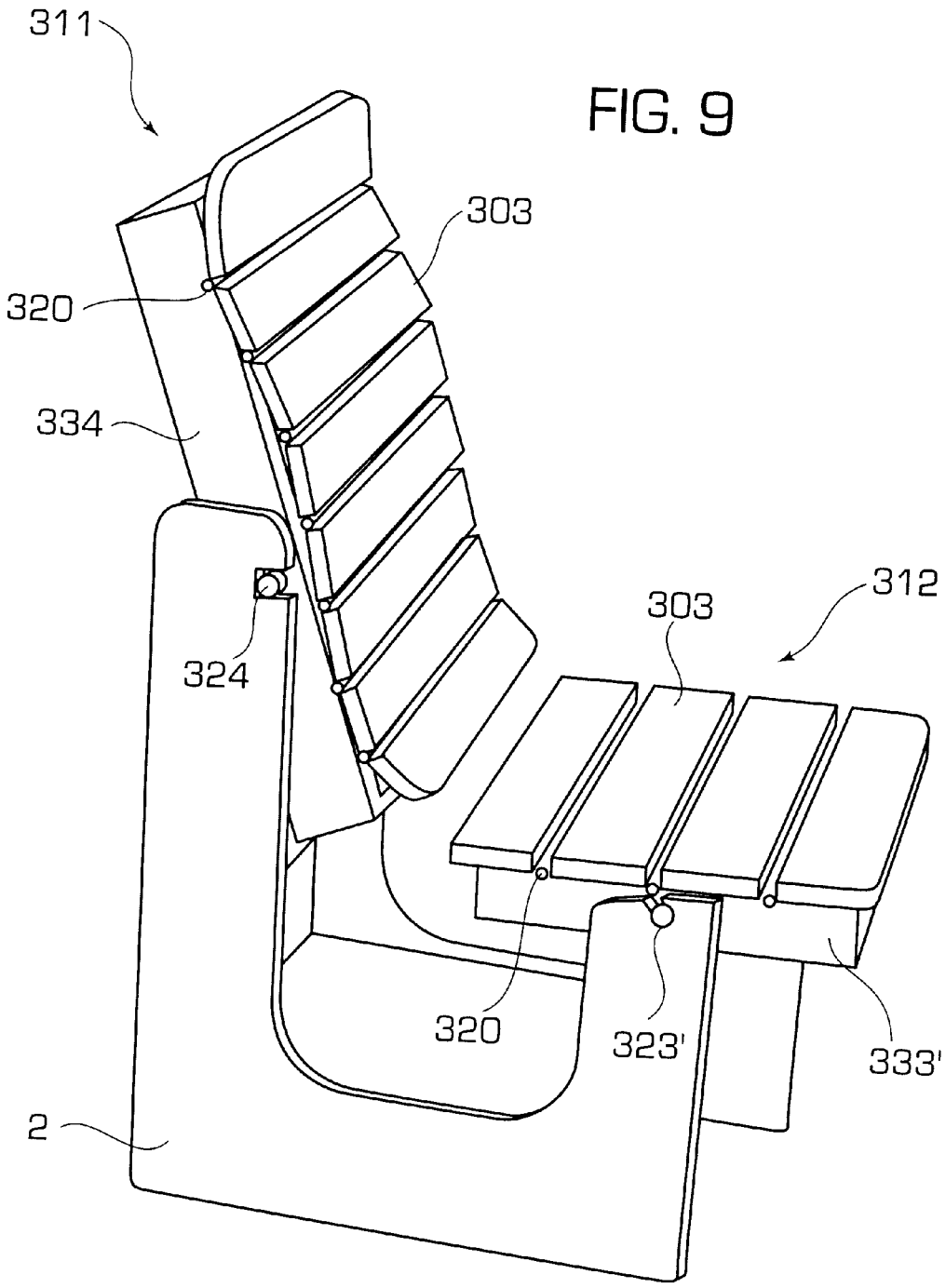
FIG. 9 shows a perspective view of yet another embodiment of the device according to the invention.

The seat illustrated in FIG. 1 comprises a back 11 and a sitting surface (not shown). Each of these elements forms a support flat 11, 12, as illustrated in FIG. 9. Each support flat 11, 12 comprises a series of laths 3 which are parallel to one another and are arranged horizontally and which are preferably connected together by means of an articulation connection 20. All the laths are connected to a central articulation point 24 by means of a lever system 31, 32, 33. The laths 3 are directly connected to one another by means of hinges 20. The laths do not all have to assume the same shape. They may be flexible and may be produced from wood or even from another material, being covered, if appropriate, with a soft or decorative material. However, the said laths 3 may serve perfectly well as elements for the direct support of the body.

However, in the preferred fundamental exemplary embodiment, the back consists completely of laths, as may be seen in FIG. 1. The arrangement of the support laths 3 parallel to one another and horizontal can be seen there. By contrast, the abovementioned connecting elements 31, 32, 33 consist likewise of laths, but are themselves arranged transversely relative to the support laths 3, as may be seen in FIG. 1.

The support laths 3 are connected to one another directly by direct-connection means 120 and indirectly by the suspension laths 31, 32, 33. The direct-connection means 120 advantageously consist of flexible elements of the cord type, which pass right through each of the support laths 3 over the entire height of the back 11 and substantially parallel to the longitudinal axis of the latter. The indirect-connection means consist of an articulated connection 21, 22, 23, 24. They may advantageously consist of small shafts when they serve as means of articulation between a pair of laths 3 and a connecting/suspension element 31. These articulation connections 21, . . . are placed removably at each end of the support laths 3, in which they come into position, on the one hand, whilst also coming into position removably in the corresponding suspension element 31, on the other hand. As regards the connection means 22, 23 provided for connecting the various suspension elements 31, 32, 33 to one another, they may advantageously be formed by shafts of the same type as those mentioned above, as may be seen in FIG. 1, with substantially identical functioning. This results in a back structure 11 which, whilst being designed completely in one and the same plane, nonetheless benefits from the advantages of a multiple-suspension system by virtue of the arrangement of the suspension elements 31, 32, 33 laterally and on each side of the support laths 3. It should be noted, moreover, that the actual structure of the support laths 3 narrows from one end of the back 11 to the other, thus corresponding perfectly to the morphology of the human body which likewise has two ends, the head and the feet, which narrow from the central zone of the human body, including arms. Armchairs are usually designed to have, on the one hand, a back 11 corresponding substantially to the upper half of the body and, on the other hand, a sitting surface 12 corresponding substantially to the lower half. In order to obtain an armchair according to the invention which harmonizes with this body morphology, the support flat forming the back 11 may advantageously be arranged with its narrowed lath part facing upwards and the support flat forming a sitting surface 12 be arranged with its narrowed lath part facing downwards, so that the zones with wider support laths 3 of each of the support flats 11, 12 are adjacent to one another.

As regards the lateral zones occupied by the suspension laths 31, 32, 33, these may usefully function as an armrest. In fact, the suspension laths 31, 32, 33 arranged in this way perfectly match the elongate morphology of the arms. Thus, a seat contour is obtained which is both perfectly matched to the morphology of the body and provides this same body with a multiple-suspension effect by virtue of the hierarchy of the suspension laths 31, 32, 33.

Furthermore, by virtue of this exemplary embodiment according to the invention, all these advantages are achieved, along with an absolutely minimal overall size of the seat. This minimal overall size, with a reduced thickness of each support flat 11, 12, whether the back or the sitting surface, is obtained by means of the lateral arrangement of the connecting laths 31, 32, 33, contrary to the known systems requiring additional overall size due to the occupation of a space by the additional mechanism of each actual flat. Another advantage, which is likewise achieved as a result of this lateral arrangement in the same plane, is the neutral equilibrium thus obtained, in contrast to the equilibria of the unstable type encountered in some known systems, in which the suspension elements are arranged underneath the actual support laths.

Figure 2:
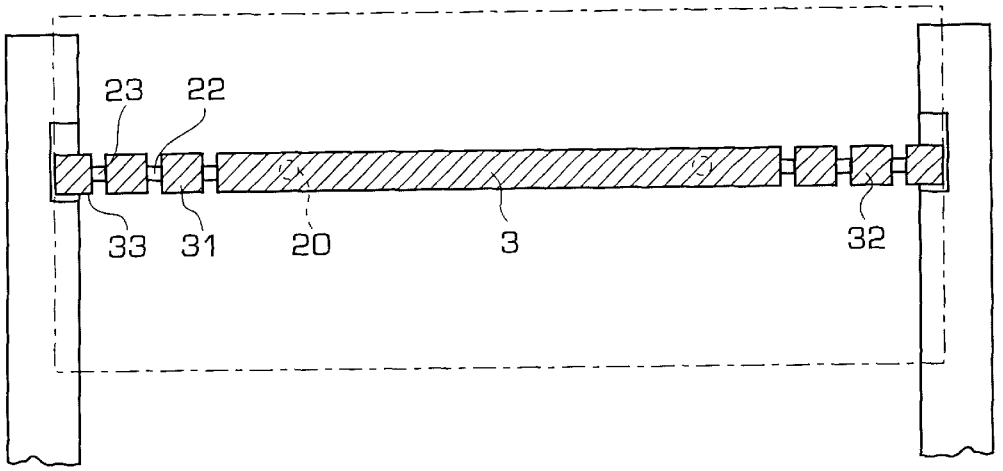

Moreover, this minimal overall size also exerts a beneficial influence on the appearance of the seat which, in addition, is made considerably lighter. Yet another advantage is the very great simplicity of the suspension system, with the capability of extremely convenient and rapid assembly and disassembly, which proves especially practical and, moreover, allows easy transport, particularly if the user moves house. The plane form of construction is illustrated perfectly in the sectional view shown in FIG. 2.

Of course, in as much as it is essentially a person's back which often presents a problem as regards comfort, and in as much as a considerable number of people are fully aware of back problems, an armchair in which only the support flat 11 forming the back would have the abovementioned lath structure and in which the sitting surface 12 could itself consist, for example, of a simple fabric, such as canvas, would prove especially advantageous, particularly with regard to cost, but also to weight.

It must also be emphasized that, by virtue of the suspension system described, a completely self-adjustable armchair is obtained. In fact, all the elements 3, 31, . . . are automatically put in place as a result of their mutual interdependence when the user sits down in the armchair and thereby comes into contact with the support flats 11, 12.

Figure 3:
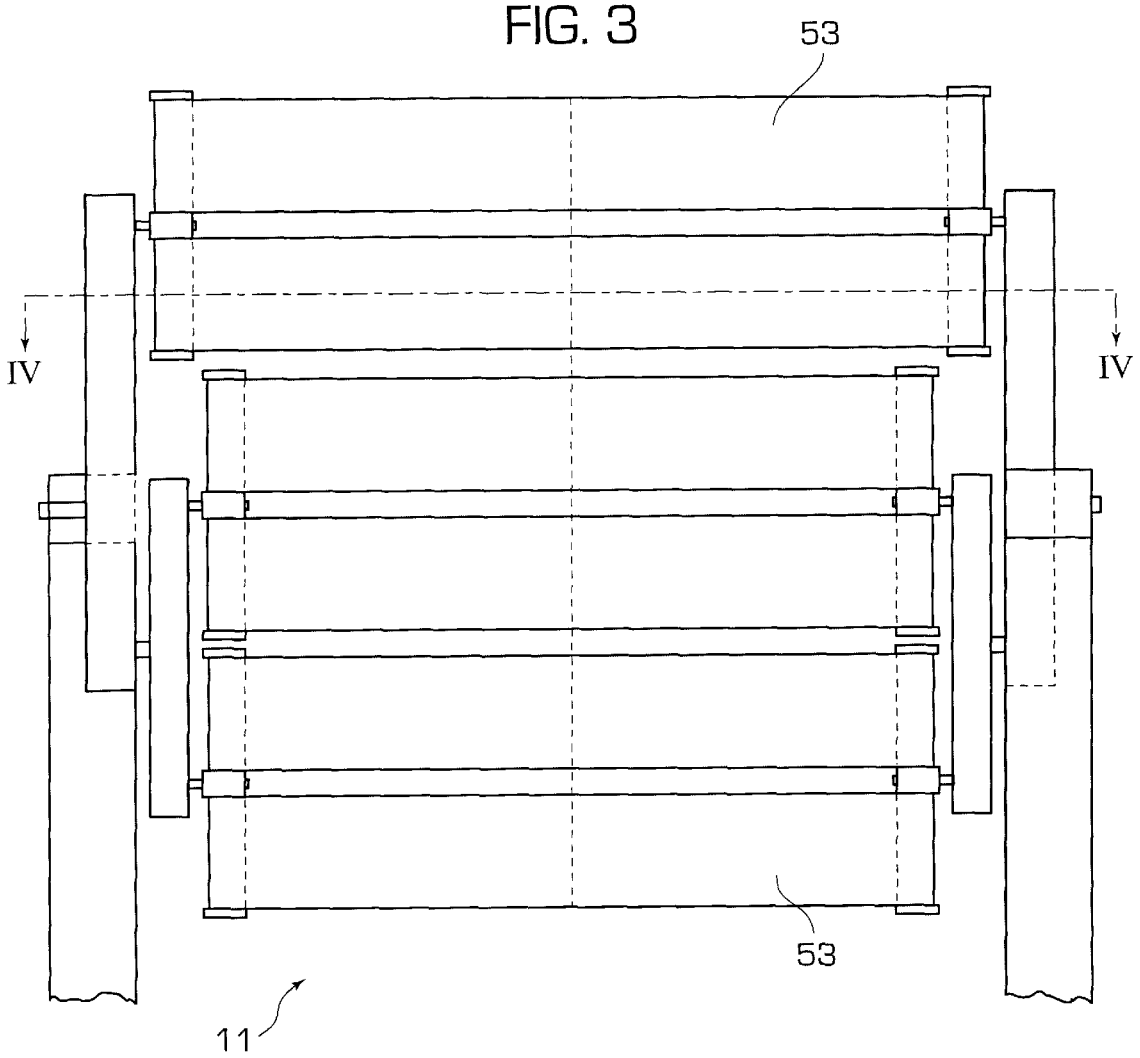
FIGS. 3 and 4, 5 and 6, and 7 and 8, respectively, illustrate other similar partial views of other embodiments of the comfort device according to the invention.
Figure 4:
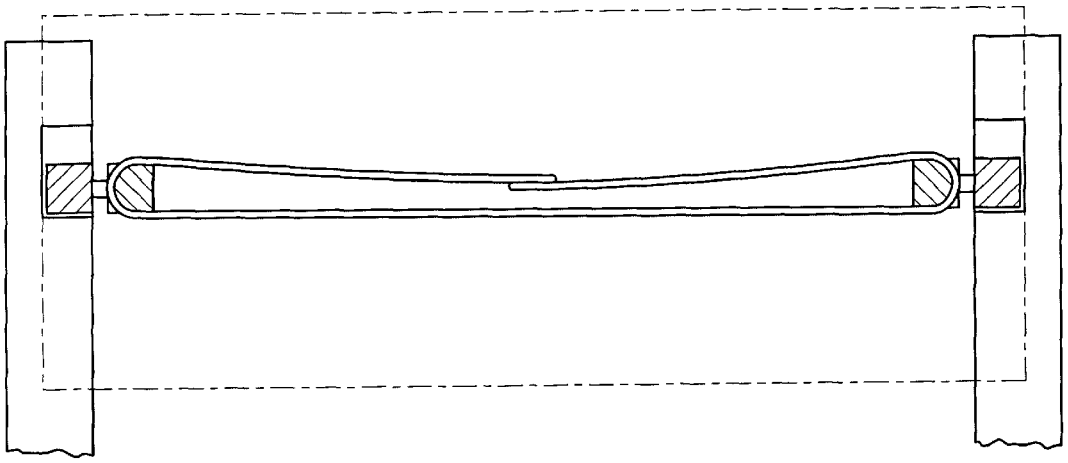

Specifically, a variant according to the invention is also illustrated in FIG. 3 and in section in FIG. 4. This variant is very similar to the preceding one, but in this one the supporting elements 3 consist of flexible straps 53 produced, for example, from a fabric such as ultra-lightweight canvas. An ultra-lightweight embodiment is thus obtained. The cross-section of each support strap 53 is shown in the sectional view of FIG. 4, in which it can also be seen clearly that this variant likewise has a suspension structure with a completely plane contour, as in the variant described above.

Figure 7:
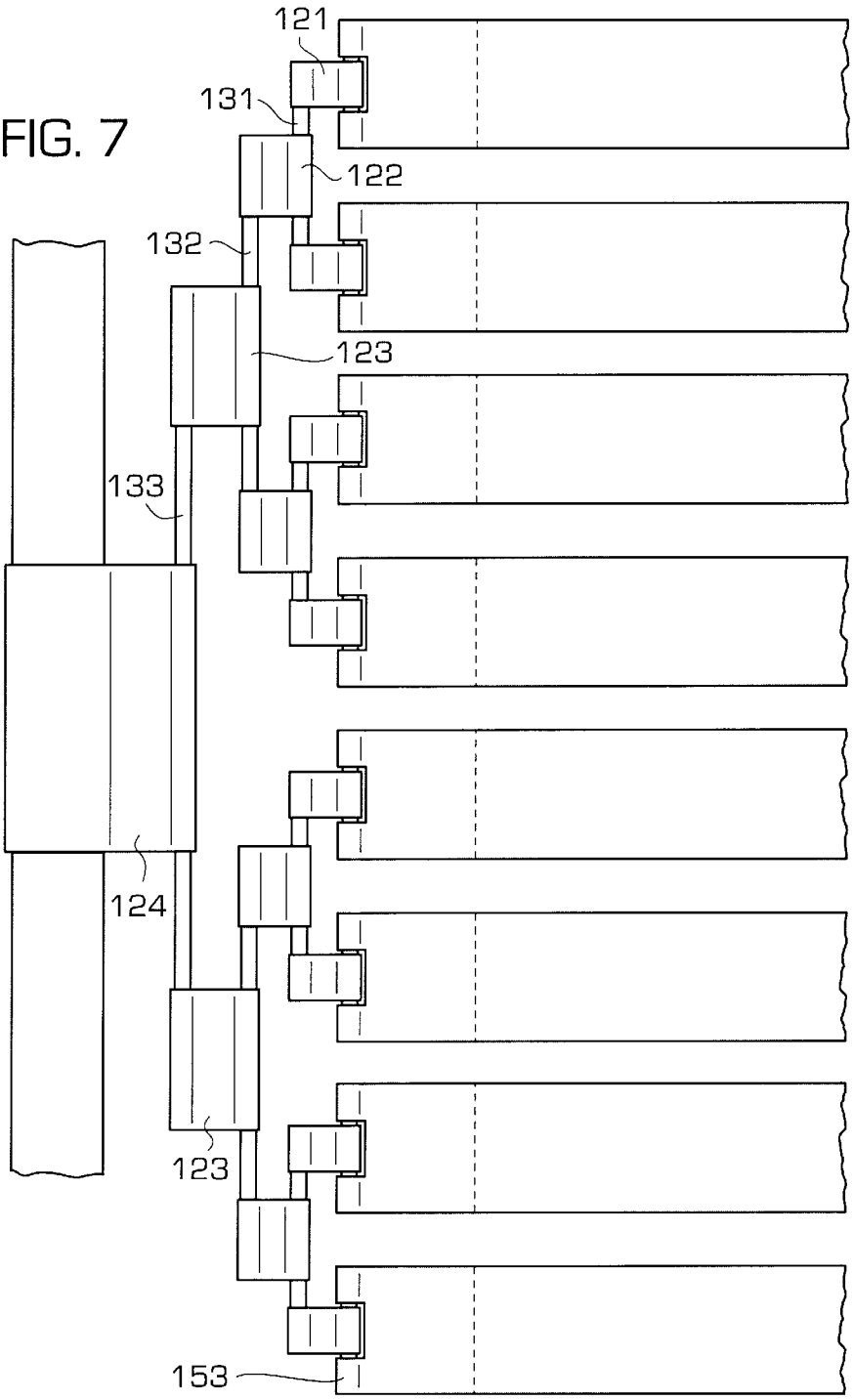
Figure 8:
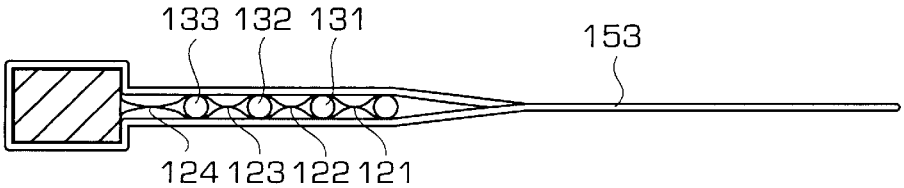

Another alternative embodiment, illustrating suspension elements 131, 132, 133 having a structure different from that of the actual support laths 153, is shown in FIG. 7, together with the partial sectional view illustrated in FIG. 8.

By means of a flexible construction of the laths, of the same type as that of the straps described above, the lateral torsion of the user can be compensated, thus allowing him more back movement.

Figure 5:
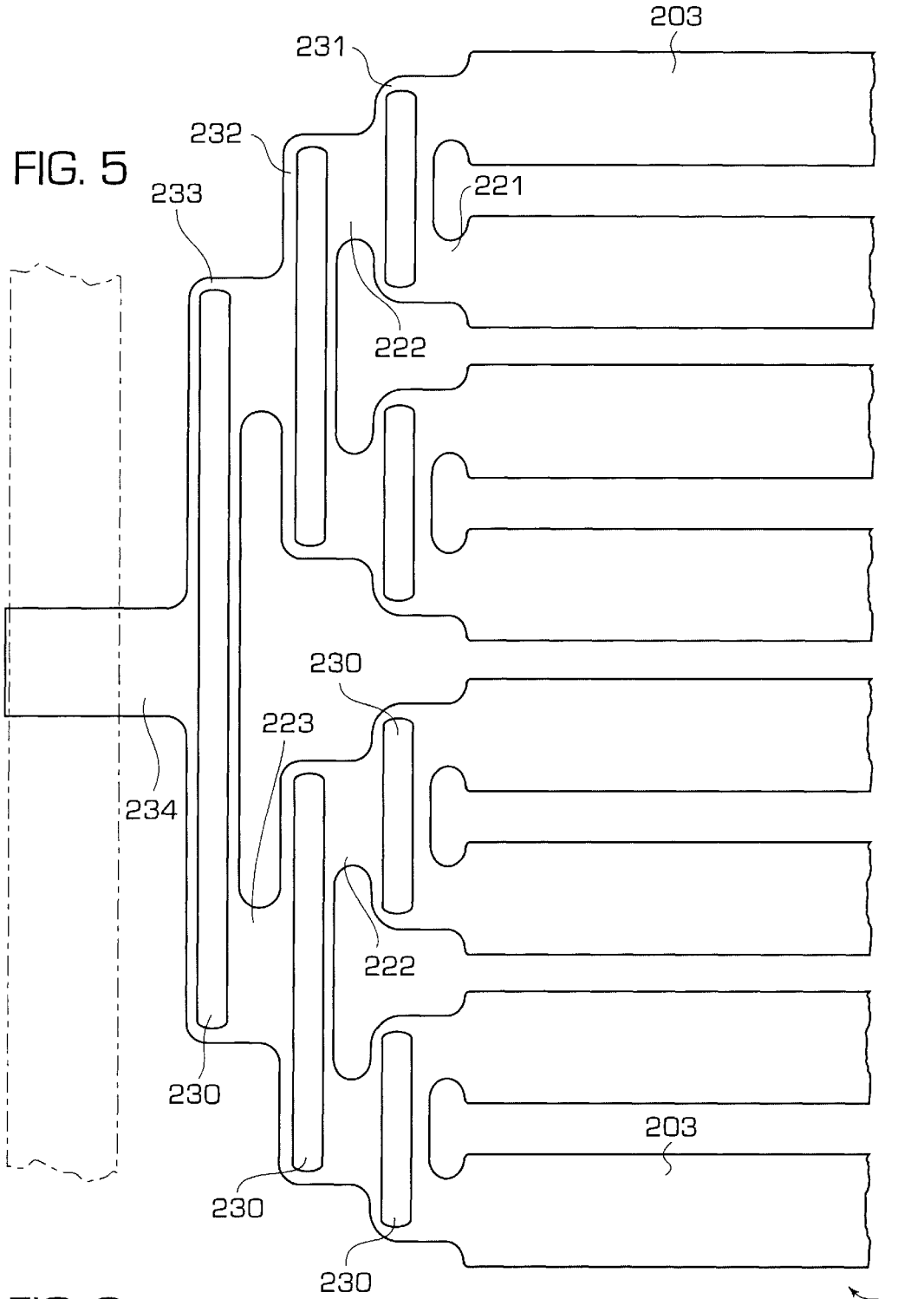
Figure 6:
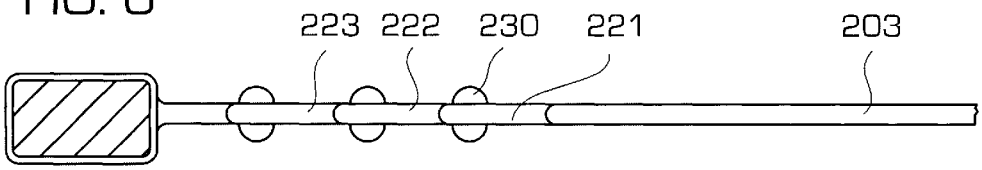

Yet another alternative embodiment is illustrated in FIGS. 5 and 6. This has very particular usefulness, since it shows the one-piece form of construction of the assembly as a whole. The articulation shafts are replaced, here, by narrowed connecting zones 221 between the support laths 203, on the one hand, and the suspension elements 231, 232, 233, on the other hand. The latter 231, 232, 233 themselves have a reinforcing zone 230 in the form of a projecting bead. These beads ensure that each suspension element, subjected to great stress when the armchair is used, have sufficient rigidity. With this embodiment, the entire support flat 211 may be produced in one piece, for example from synthetic material, in particular by injection moulding. In fact, all the supporting elements 203 and suspension elements 231, 232, 233 are attached to one another by means of attachment zones 221, 222, 223, 224 which each time are narrowed and which function as coupling or articulation, as described above. Thus, an extremely advantageous and inexpensive manufacturing process is obtained, making it possible to produce at a very high rate a comfortable armchair which provides comfort comparable to that of the variants described above owing to the presence of the lateral suspension elements 231, 232, 233. In this case too, the form of construction is in one plane, as shown in the sectional view illustrated in FIG. 8. Advantageously, the zones 221, . . . , 224 are narrowed longitudinally (FIG. 5), but also in thickness, as may be seen in FIG. 6.

As a particular variant of the one-piece embodiment, it is possible, in particular, to provide inflatable modules which each form support flats 211, . . . .

Another variant will now be described and illustrated by FIGS. 9 and 10, together with a diagrammatic representation illustrated in FIGS. 11–12 and 22–23.

Figure 11:
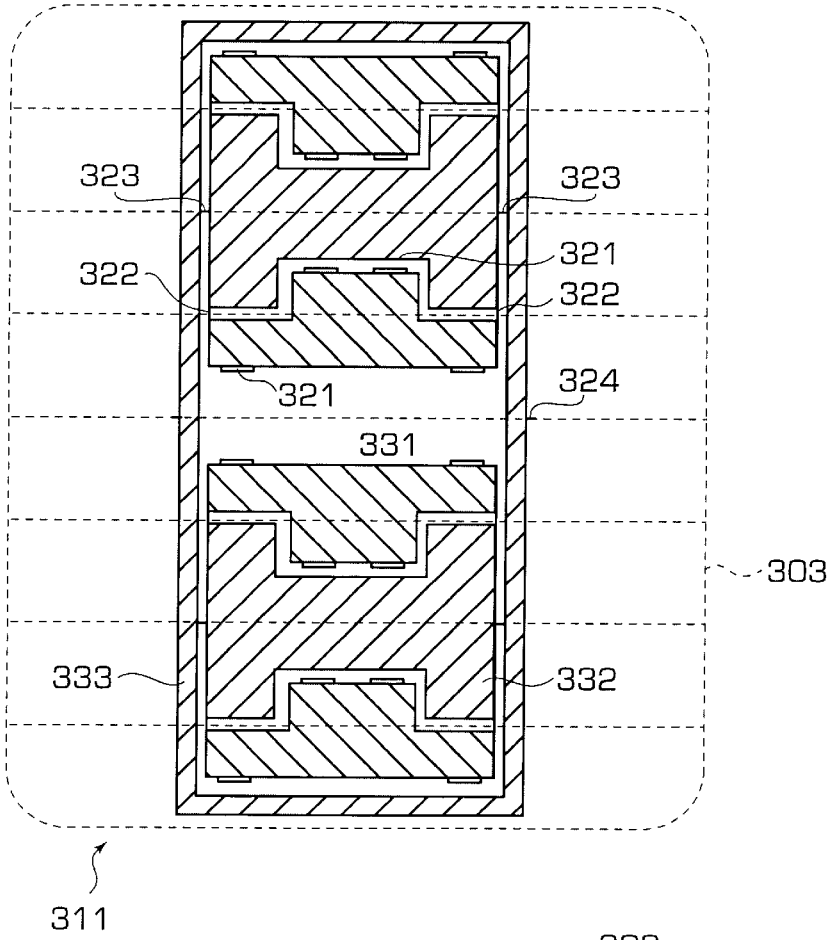
Figure 12:
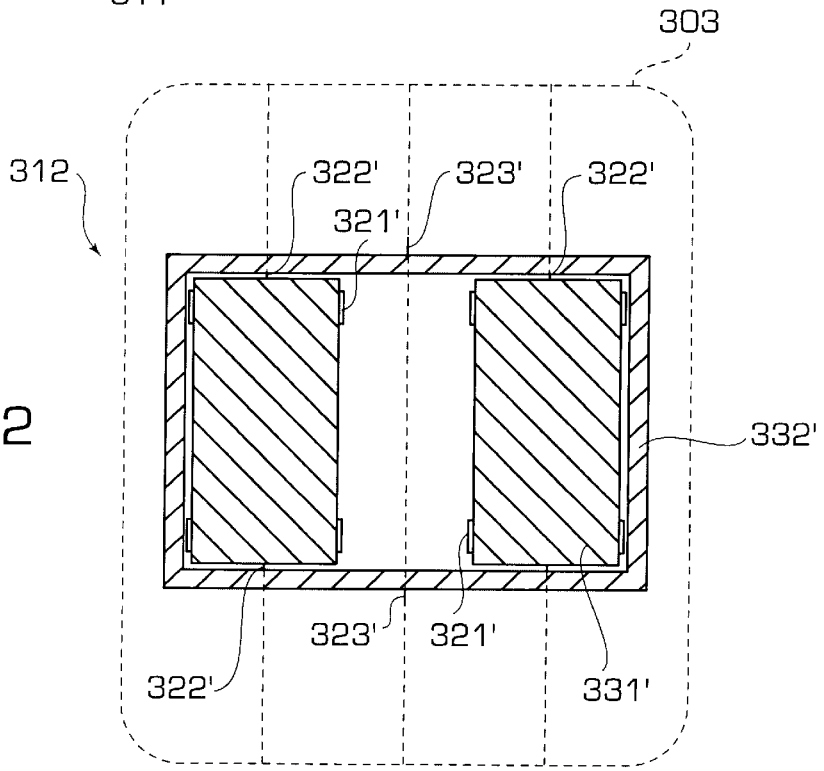
Figure 13:
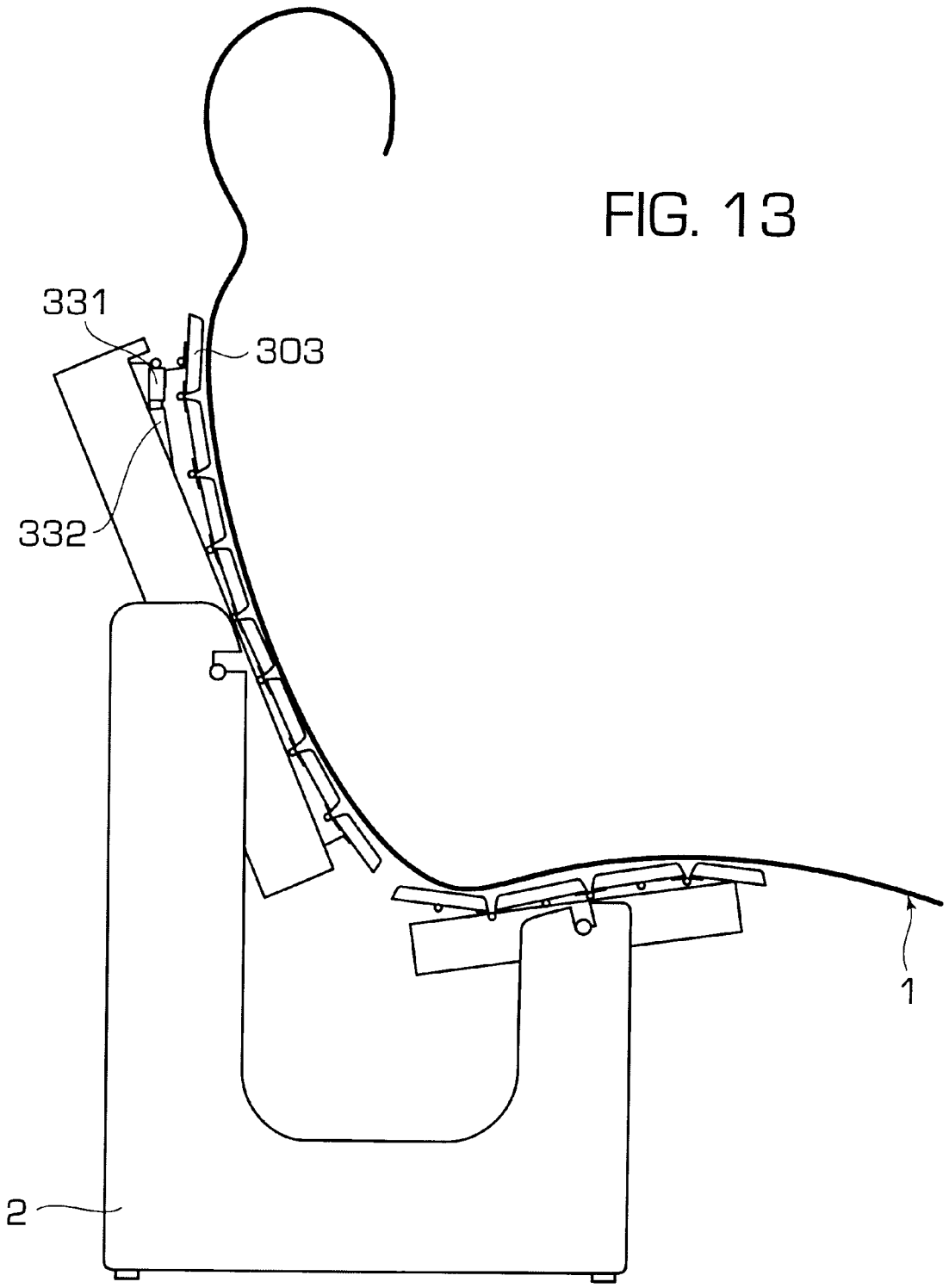
Figure 14:
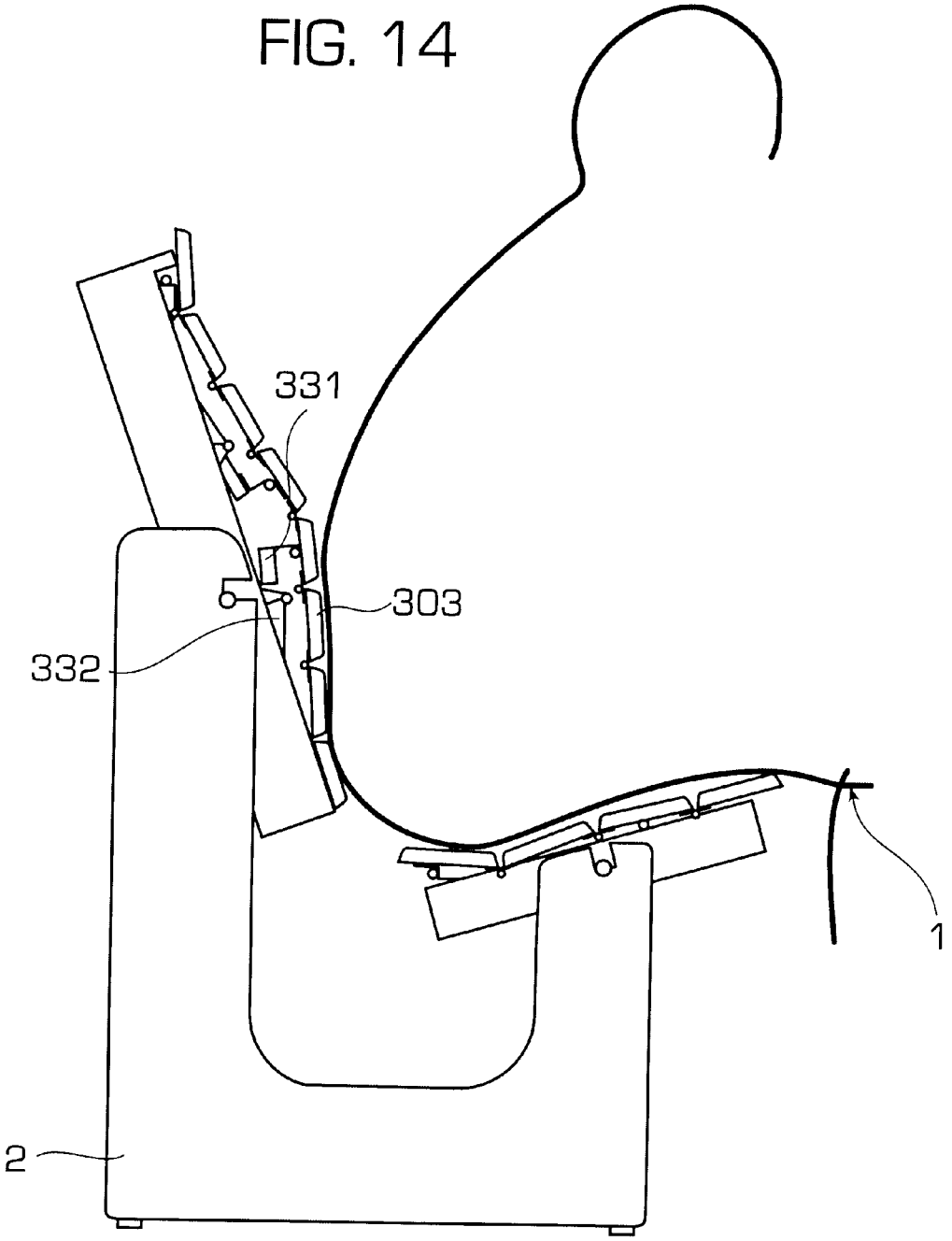
Figure 15:
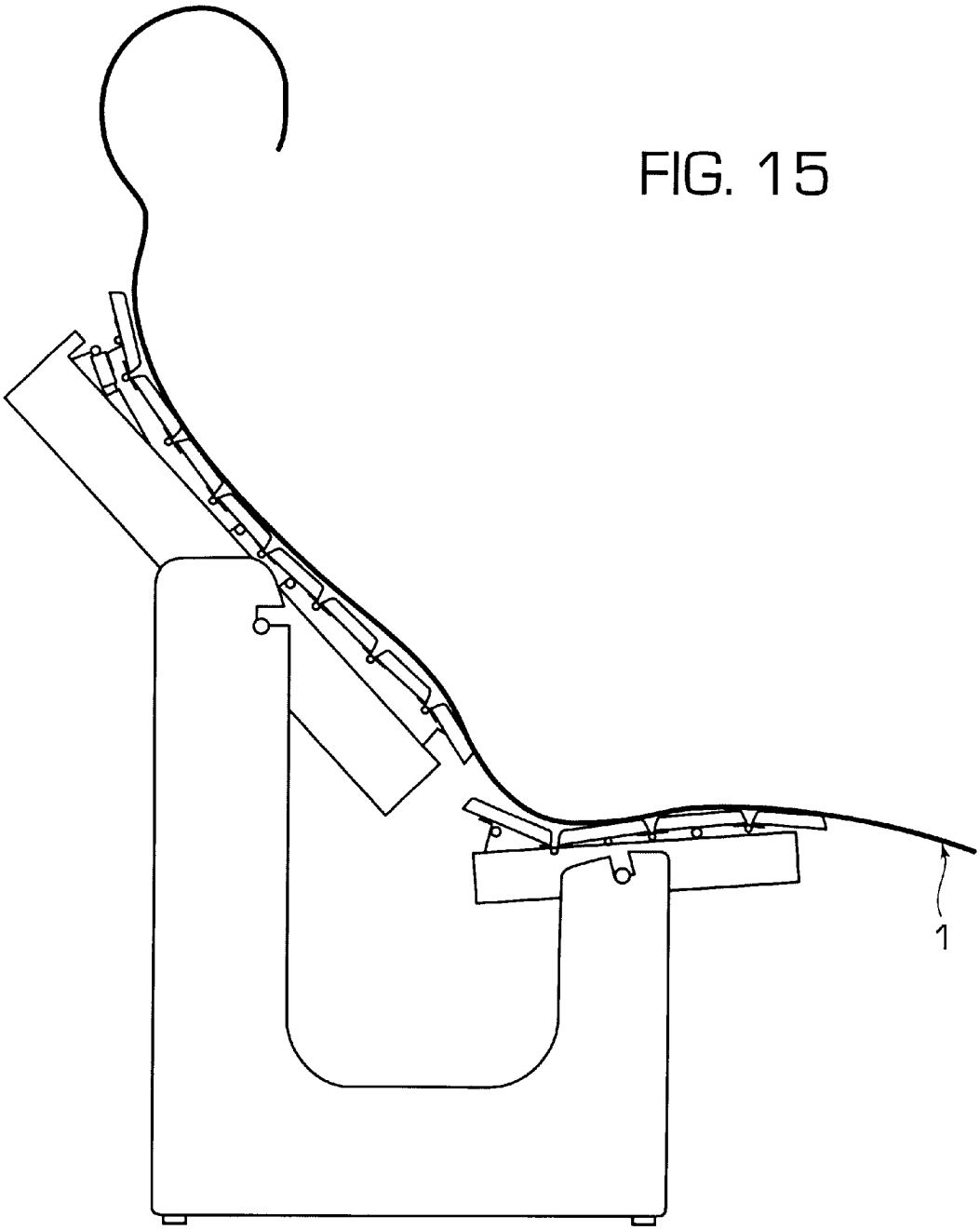
Figure 16:
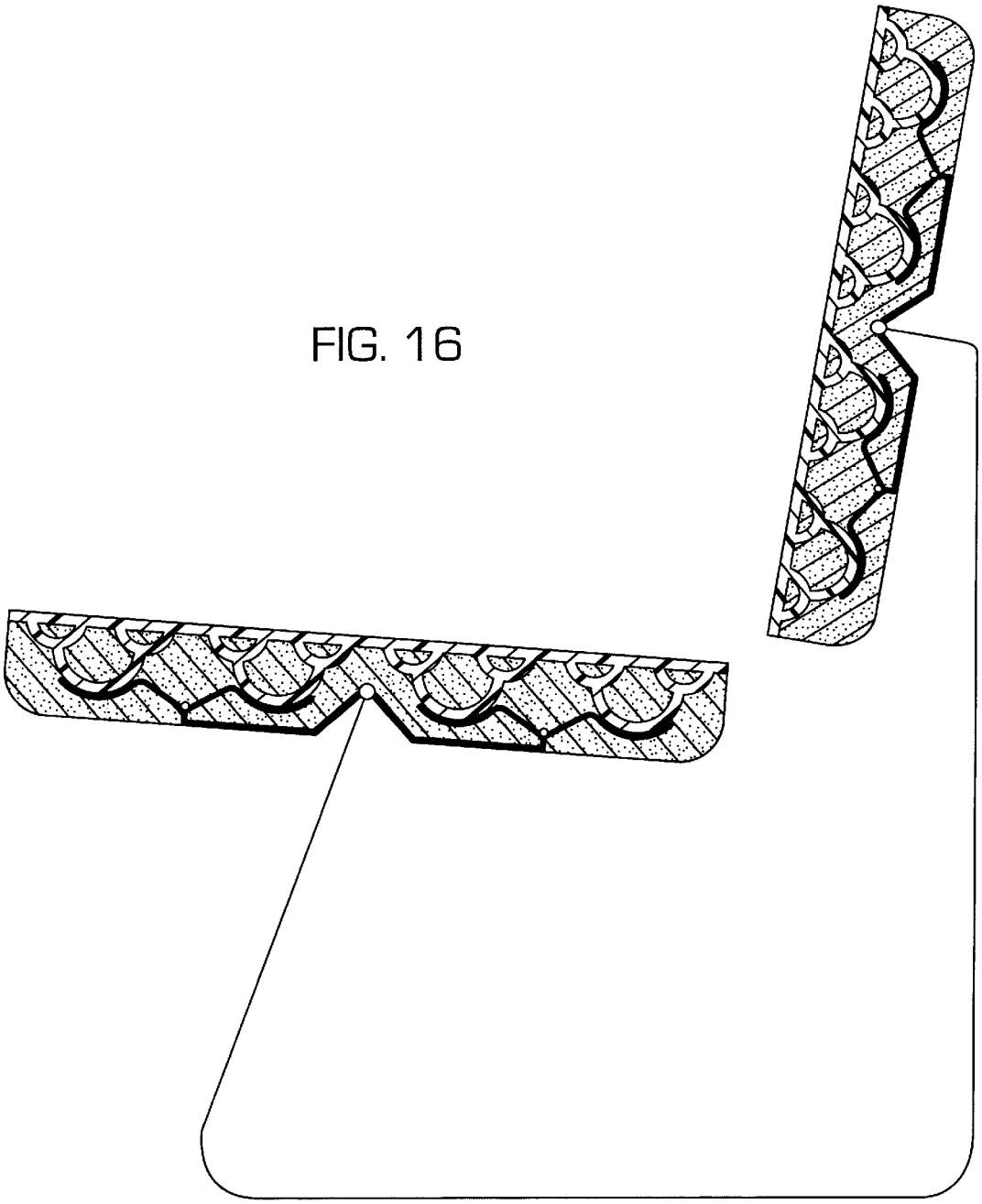
FIG. 16 shows a view, similar to that of FIG. 10, of another embodiment according to the invention.

In the variant described below, the suspension elements 331, 332, 333 have a structure which is capable of allowing an interlocking of these, as emerges from FIGS. 11 and 12 for the back 311 and for the sitting surface 312 of an armchair respectively. Thus, there may be seen lath-like supporting elements 303, represented by dots for the sake of illustration, which are each fastened, by means of a double articulation connection 320, 320 and in pairs, to a primary connecting element 331 having, for example, a T-shape and each time joining together a pair of laths 303, 303 adjacent to one another. The T-shaped primary connecting elements 331 are, in turn, joined in pairs to a secondary connecting and suspension element 332 which advantageously has an H-shape and in which are interlocked the two T-shaped primary elements 331 on respectively opposite sides of the corresponding secondary element 332. The H-shaped secondary elements are, in turn, connected to a box-shaped tertiary element 333 which fixes together the two subassemblies having the abovementioned structure of H-shaped elements 332 surrounded on either side by T-shaped elements 331. Thus, this variant, too, has the two-by-two connecting structure at hierarchical levels. Advantageously, each of the connections between elements of successive levels 331–332, 332–333 is made by hinge-type articulation connections 321, 322 and 323 respectively. FIG. 12 shows a simpler arrangement of the sitting surface 312 for this variant. Although this embodiment is more bulky, it nevertheless has tried and tested durability and it is especially suitable for larger seat contours. FIGS. 22 and 23 show once again an overall diagrammatic illustration of the abovementioned alternative embodiment in the position of rest A and in the loaded position B.

Figure 10:
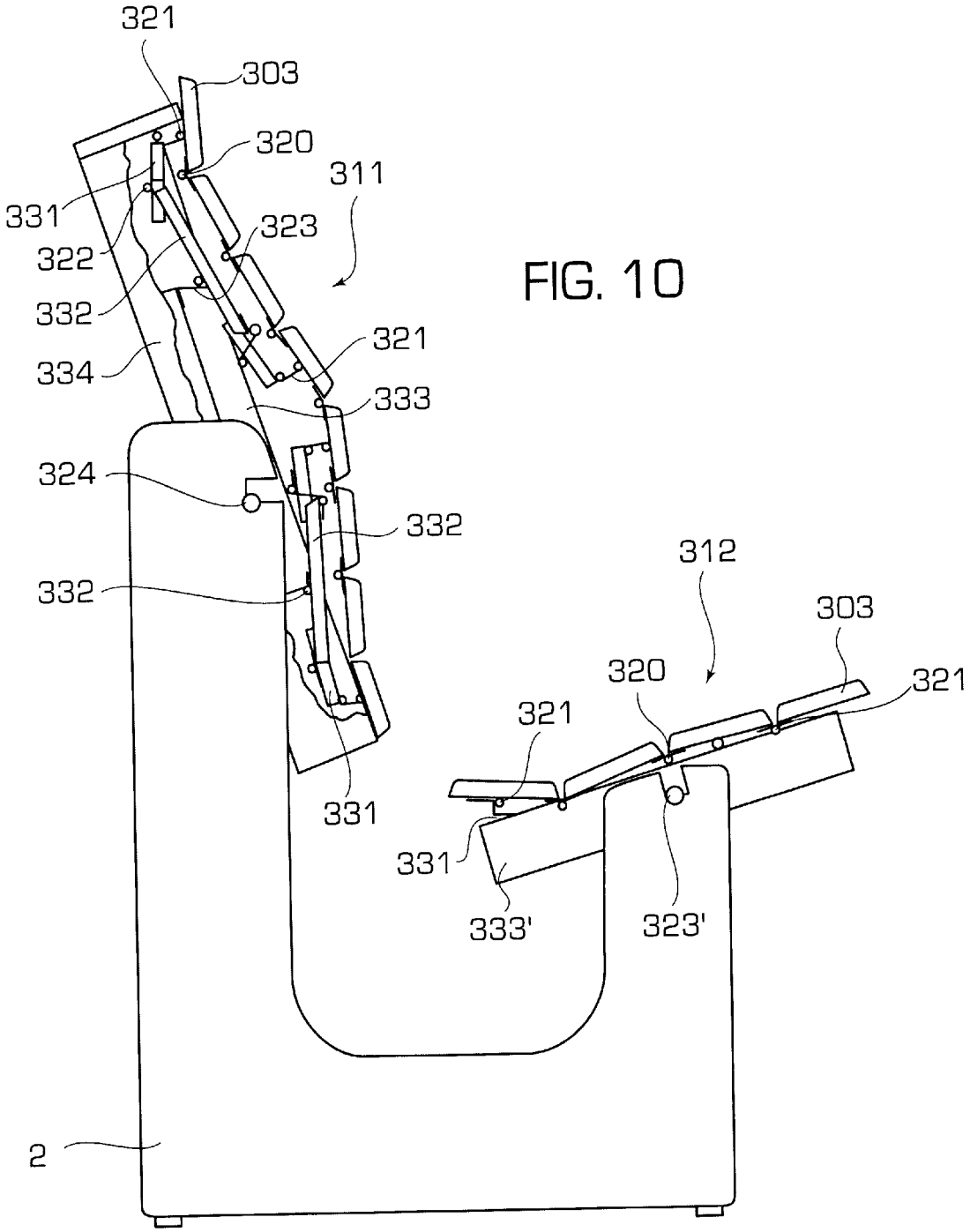
FIGS. 10 to 15 show particular features relating to the arrangement and functioning of the embodiment illustrated in FIG. 9.

A more detailed illustration of this alternative embodiment, with the back in an arched position, is shown in FIG. 10. This Figure shows a partially cutaway side view of the back 311 in an arched position, in which the interlocking cooperation between the intermediate connecting parts and primary suspension parts 331, on the one hand, and the corresponding secondary parts 332 can be seen clearly. Moreover, it emerges clearly that the tertiary element 333 forming a box affords protection for the suspension system of the device according to the invention.

All the alternative embodiments described hitherto have the great advantage of being completely self-adjustable, in as much as it is the user's act of installing himself in the device which causes the supporting and suspension elements to be suitably put in place, with substantially uniform pressure on all the exposed parts of the body, that is to say those in contact with the abovementioned elements of the device.

Figure 27:
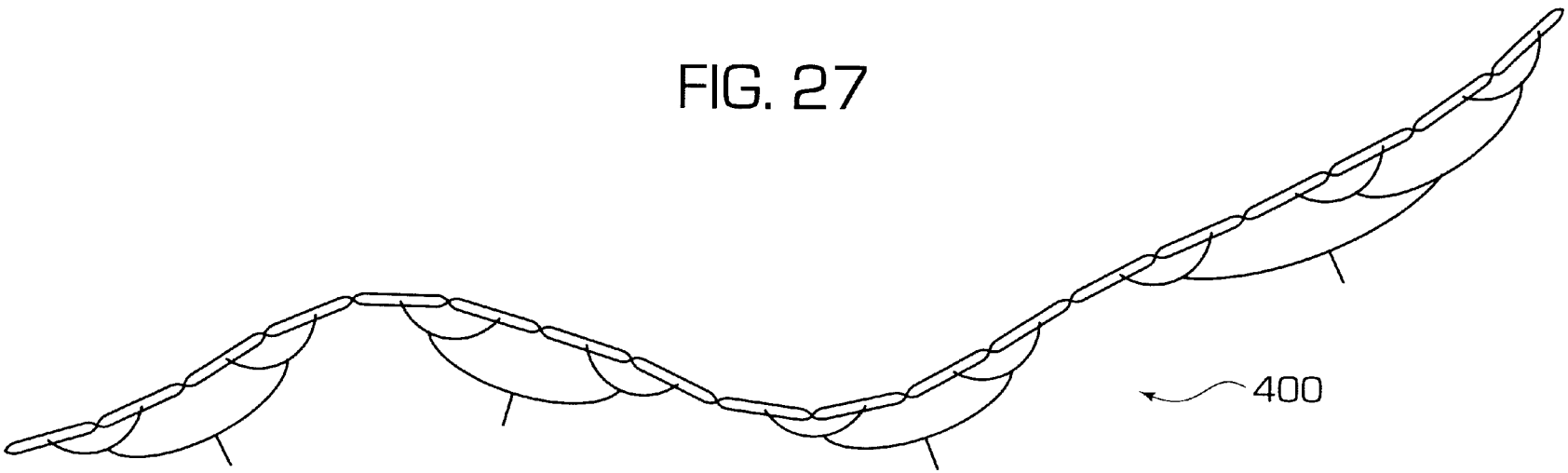
Figure 28:
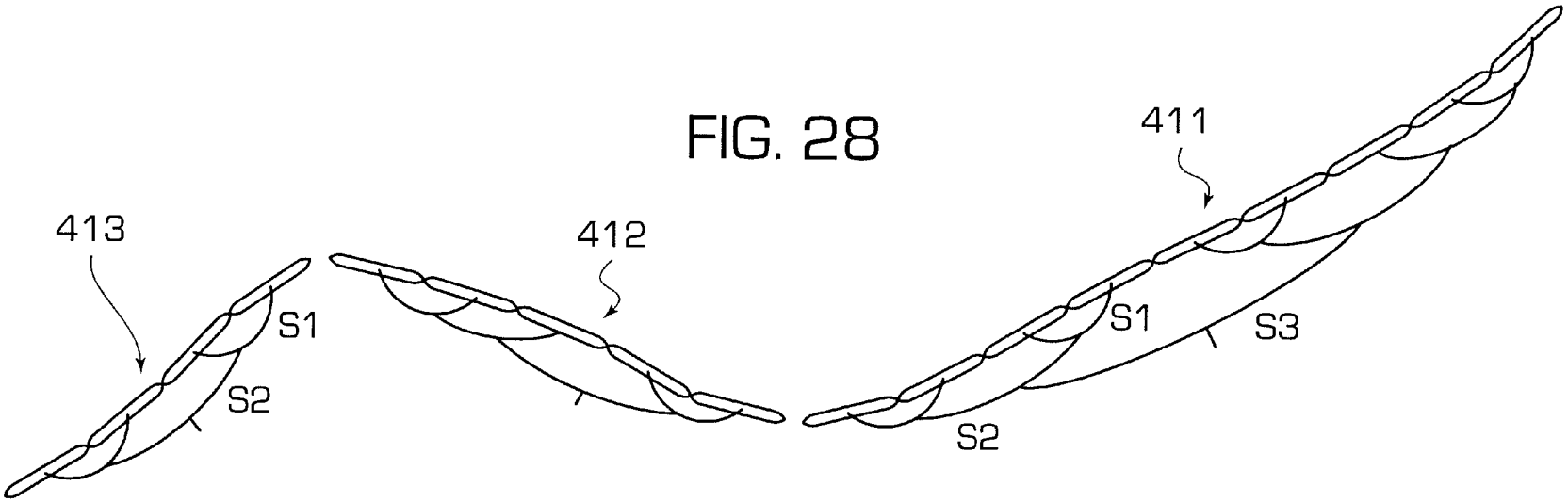

FIG. 28 shows the arrangement of three support flats 411, 412, 413 which together form a recliner 400 with multiple-level suspension of a form similar to that described for the other alternative embodiments above. The production of a recliner from a single support flat is illustrated in FIG. 27. The frame may likewise be made adjustable, particularly in the case of the recliner 400.

It goes without saying that the support flat, as described above, is also suitable for pre-existing furniture, such as a car seat or a heavy goods vehicle seat and the like.

The functioning of the device is described below.

The user 1 bears with the whole of his back on a single articulation point 324. The counterpressure is distributed uniformly over all the laths 303 of the seat back 311, so that these 303 assume perfectly the shape of the user's back. Thus, the system behaves in exactly the same way as the rubber band of a windscreen wiper which continually assumes the shape of the wiped windscreen during the travel of the windscreen wiper. (See FIGS. 20 and 21).

The articulation points form a connection between two elements or parts, allowing these elements to be displaced relative to one another about an axis which is fixed relative to the said elements or, when necessary, which is displaceable.

An articulation point may also consist of a plurality of articulations which are mounted next to one another. They may be formed from metal, from hardened synthetic materials or even from a flexible material (see FIGS. 10, 22–23).

Figure 20:
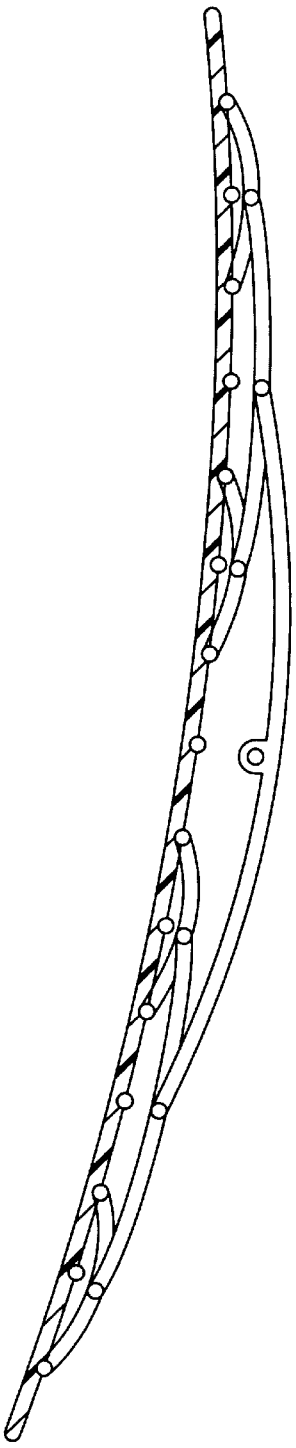
Figure 21:
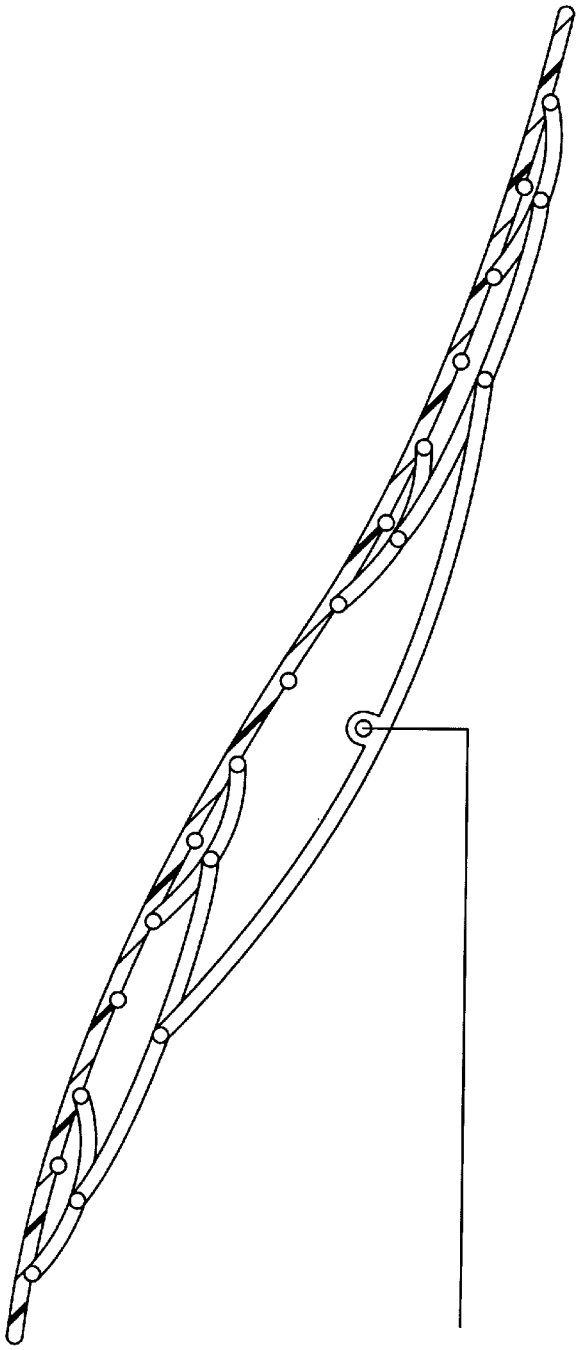
Figures 22, 23:
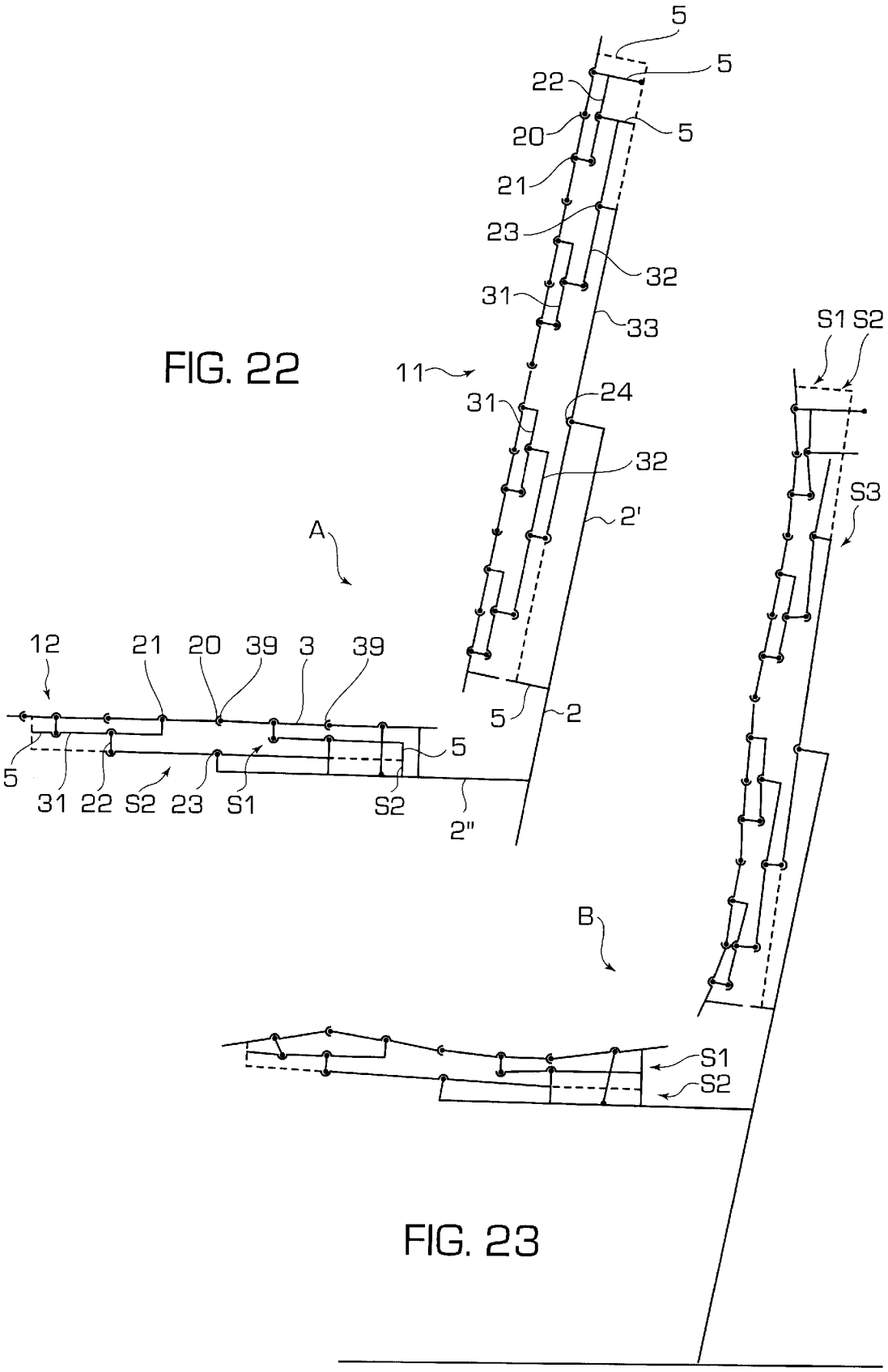
FIGS. 22 to 28 show diagrammatic views of alternative embodiments of the device according to the invention.

Similarly, in this case, the pressure comes from a single articulation point, and it is distributed uniformly over the entire length of the wiping band by means of articulated levers, thus revealing the analogy with a vehicle windscreen wiper, as emerges from FIGS. 20 and 21.

The user may therefore continually change posture in the seated state, whilst his back and bottom remain supported uniformly throughout. From then on, no posture or movement gives rise to a load on the muscles of the back. The shape of the seat back continually matches that of the user's back. The result of this is that there is the feeling of being seated more gently on wooden laths, such as those provided according to the invention in the first alternative embodiments described with the laths 3, than on even the softest cushions. In fact, the body is balanced on only two articulation points 323', 324. Even when the user is virtually immobile, it must be borne in mind that he is nevertheless moving, if only very little.

The seat back and the sitting surface can tilt together. In a position tilted backwards, the same posture is adopted as in a lounge armchair or recliner, and, in an upright position, the same as in an office seat. In the latter case, numerous activities must be provided for the seated user, since there are many office activities, in particular a writing position, a position involving activity on a computer, or a telephoning position each compelling the user to adopt respectively different postures for his back. By virtue of the armchair according to the invention, the seat back assumes perfectly the corresponding shape of the user's back according to the needs of the moment and gives him complete support. It is thus possible to be in an upright position, whilst having the back relaxed and supple, this being achieved even after a prolonged seated posture.

The suspension is produced by means of the articulation points which are connected to the frame. In order to prevent the support flats 11, 12, 13 from assuming an awkward shape in the non-loaded state, suitable return means are advantageously provided according to the invention, allowing the support flats and/or the intermediate suspension parts to resume the desired traction or thrust position, as illustrated in FIGS. 35 to 38 by the arrows of different amplitudes for the last two figures, showing a suspension system in the box S, S', the latter not being provided in the seats according to FIGS. 35–36 (uniform amplitude).

The number of articulations and of intermediate suspension parts depends directly on the number of laths, of which the support flat consists, and on the desired mobility. The combinations may be made more complex and/or simpler than those illustrated in the figures, depending on the desired parameters in terms of the mobility of the support laths.

When the body comes into contact with the support flat, the latter assumes the shape of the body, in such a way that the support flat continually follows the movement of the body in the variation of its posture, and the pressure on the body is constantly distributed uniformly.

Another alternative embodiment is described below with reference to FIGS. 25–26 and 39 to 44.

In this alternative embodiment, each support flat 511, 512 is made movable by another type of suspension means.

In the example illustrated, each support flat consists, once again, of a series of laths 503 which are connected to one another by means of hinge connections 520. Each lath 503 is fastened to one, two or more double rollers 581 (two double rollers in the example illustrated), on which suspension cables 584, 585 can travel without deviating. The double rollers 581 can rotate independently of one another. If appropriate, the left and right rollers can rotate integrally with one another on a common rotary shaft 599.

The support flat 511 is tensioned between two cables 584, 585 which are fastened to the end of the frame and execute a zigzag travel by means of the rollers 581, corresponding to the laths and fastened to these 503 by the element 587, and by means of the rollers 582, which are fastened to the frame 590.

One of the cables 584 receives the force which is exerted on the support flat, whilst the other cable 585 pulls on the support flat against the frame. Each cable can be tensioned by a return means, such as a spring 586, thus making it possible to moderate the variation in length.

In order to prevent the support flat from assuming any shape in the non-loaded state, the latter may be fastened at the top to a movable hinge. Stops may be arranged on the frame, the said stops preventing a lath from being displaced in a direction which is not desired. The support flat may be forced into a straight state by means of a tensioned cable or of a lath or casing which is pushed underneath against the support flat.

A frame may be fastened to the substructure in an articulated manner.

The lath system, having substantially the same width, functions perfectly for supporting the parts of the body individually, such as the back, bottom and legs, which exert virtually the same pressure on the support flat over substantially their entire length.

As regards the seat of the recliner type, proceeding in the simplest way, three separate support flats 411, 412, 413 detached from one another are provided. However, when the intention is to rest the entire body on a single support flat, it must be borne in mind that the back exerts more pressure on the single support flat over a length of at least twenty centimeters than the legs over the same length. Consequently, in a lying position, the lightest parts of the body, that is to say the legs and head, are pushed into the air. In each of the alternative embodiments described above, both those based on support laths suspended by elements of a similar type and in that with cables as suspension means, this problem is overcome.

In the first system, the articulation points which support the laths and the intermediate parts are displaced in the direction of the location from where the highest pressure originates. Thus, the lever arm is shortened at the location where the pressure increases.

In the other alternative embodiment with cables, the laths 503 are narrowed and the supporting rollers 582 are mounted nearer to one another at the location where the pressure on the support flat is highest. This procedure ensures that all the rollers 581 are pushed against the cable with substantially the same pressure.

When the intention is to use laths of the same width, separately tensioned cables will preferably be used for each body part which exerts substantially the same pressure over its entire length.

The device according to the invention may support the body directly or require only a very thin covering layer.

Only in regard to the device according to the invention is an embodiment described, according to which the support laths are connected directly to one another by means of a corresponding connection, particularly of the articulation type or of the connecting-cable type.

In the variants described above, a spring or counterweight is provided above the seat back in order to prevent the latter from collapsing. However, it is also possible to suspend a series of laths on each side of the mechanism, in order to obtain this same effect. Each lath serves as a counterweight for the lath which is mounted on the other side.

This has the following advantages:

in this latter case, the springs once again serve solely for returning the support laths to the non-loaded state in the straight initial position, and the said springs therefore no longer serve to suspend the weight of these laths. The rear side of the seat back is completed in this way, particularly in the case of the variant illustrated in FIG. 9.

The lateral sides of the seat back are likewise completed by the arrangement of flaps perpendicular to the ends of the laths, and, moreover, the suspension mechanism is concealed thereby. On both sides, the laths may be completed by means of various coverings, and the seat back may be mounted reversibly. The same arrangement may also be provided for the sitting surface 12.

Figure 17:
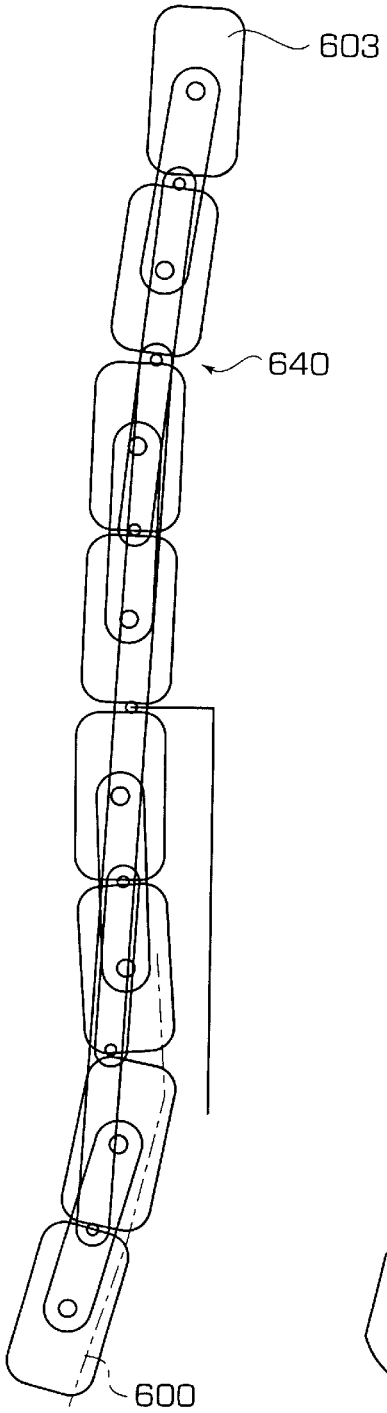
FIGS. 17 to 21 show a view of detail of an embodiment of part of the comfort device according to the invention.
Figure 18:
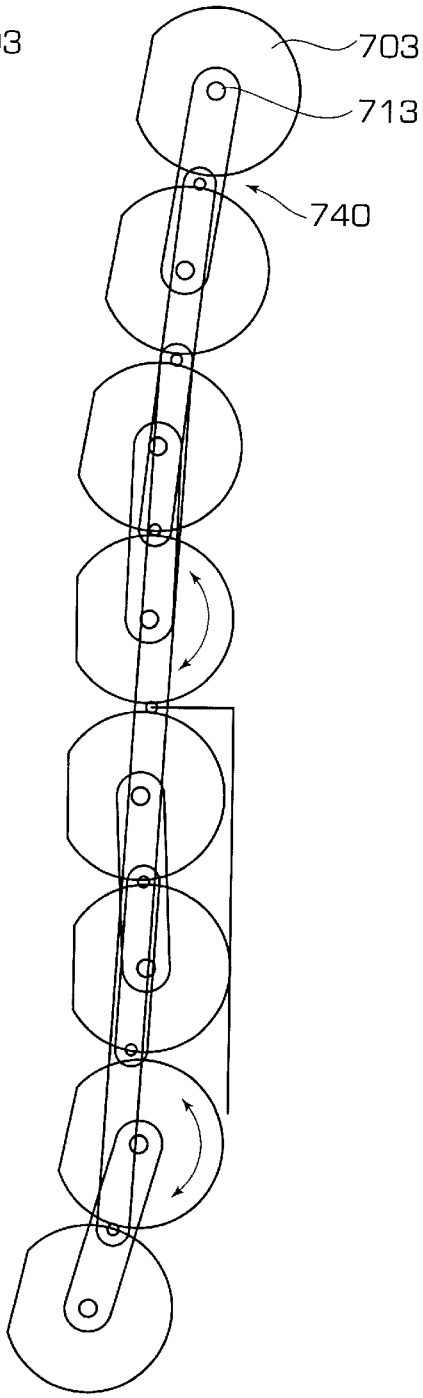
Figure 19:
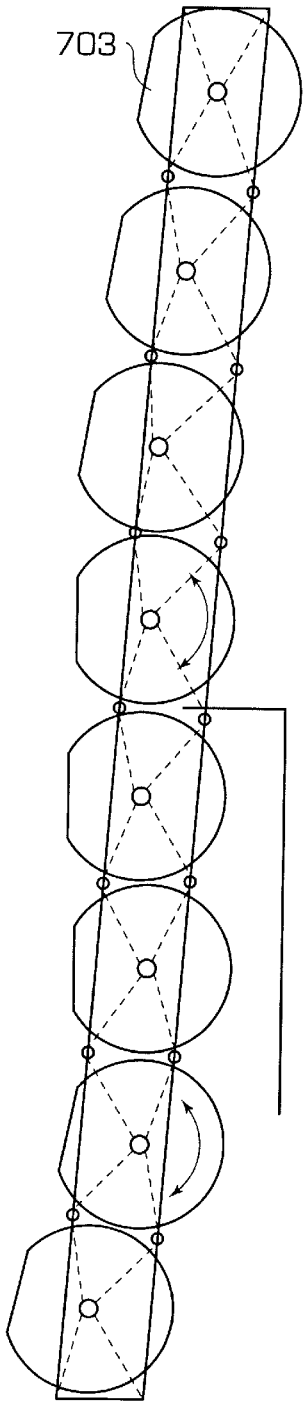

As another alternative embodiment described in FIGS. 17 to 19, there may be provision for the supporting elements 603, such as the laths, to be connected directly to one another by means of hinges, as described above, or alternatively they may also be arranged so as to rotate freely about a longitudinal axis of rotation, in this case a small gap 640 being provided between supporting elements adjacent to one another. As regards supporting elements in the form of laths, these must then be pulled in the correct direction by means of a flexible connection 600. When small rollers 703, which are preferably produced from a compressible material, are used, these may then rotate completely about their axis 713. Furthermore, the rounded shape of the supporting elements 703 may exert a stimulating action on the body parts in contact with these, thereby affording a pleasant effect. In the variant with a gap 640, moreover, pleasant ventilation is induced on the body part being supported.

Figure 24:
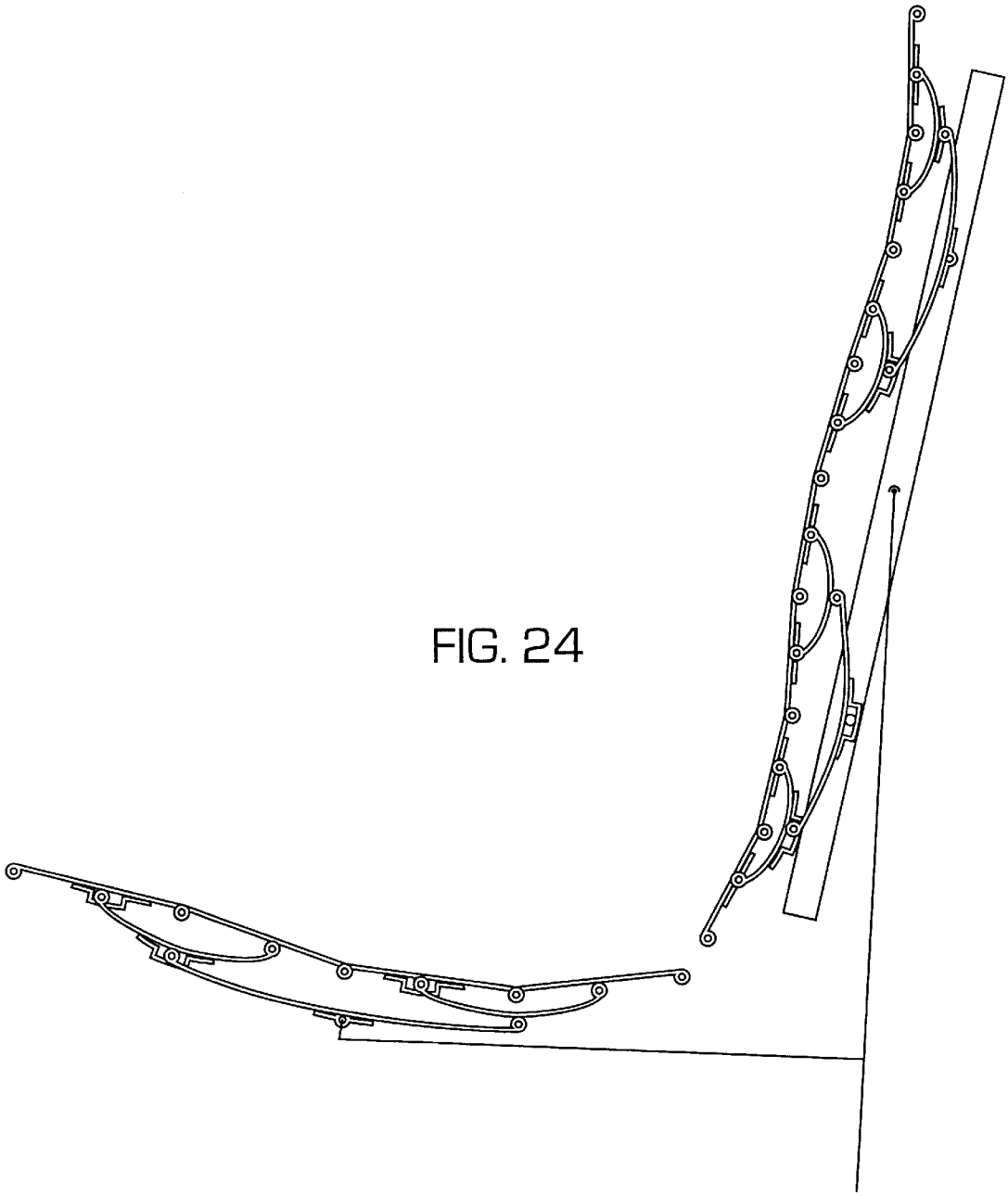
Figures 25, 26:
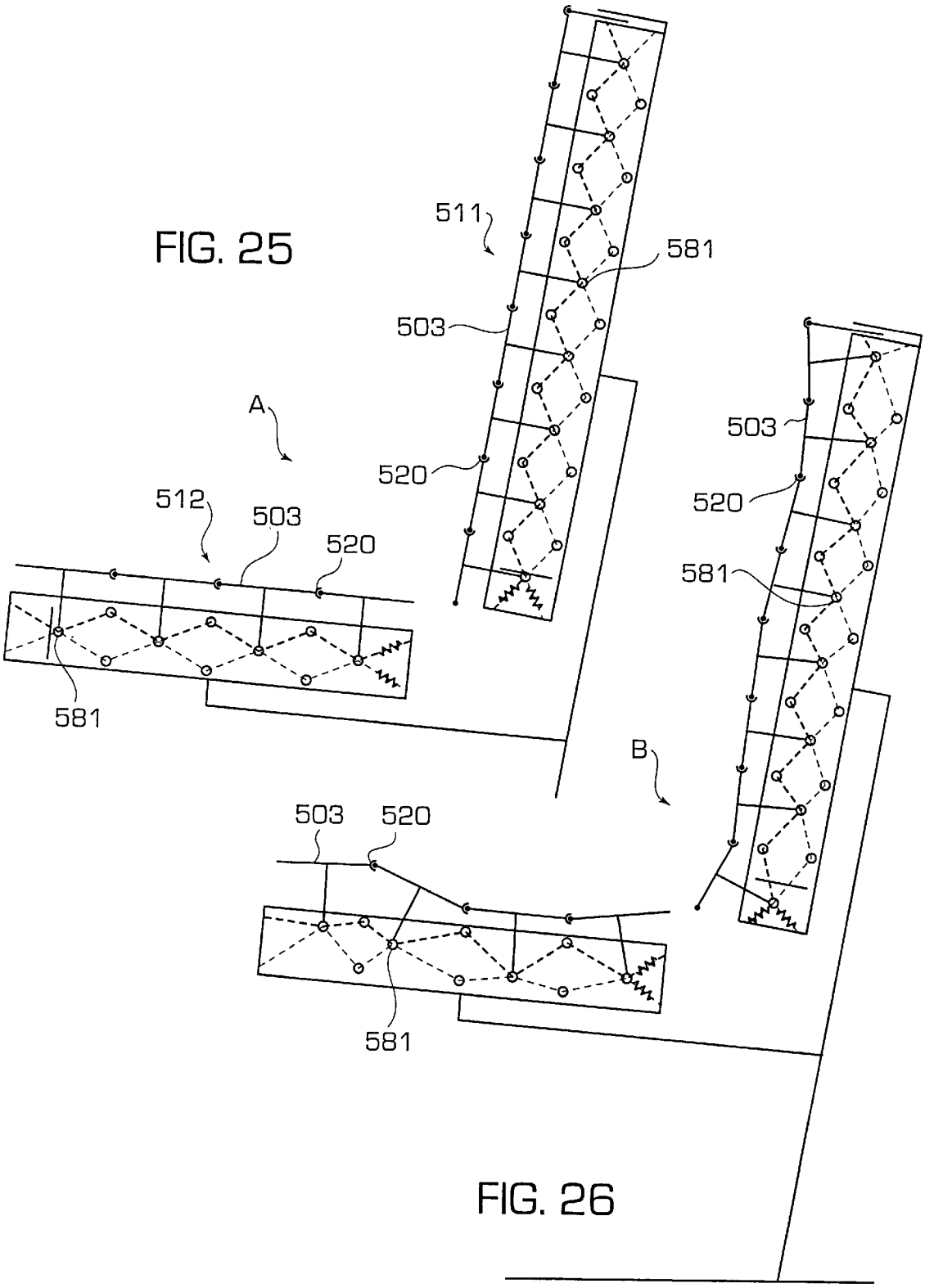

It should be noted that, in the variants of the windscreen-wiper type described above, it is possible to employ a symmetrical mechanism, as illustrated in FIGS. 20 and 24, or an asymmetric mechanism, see FIGS. 20 and 21. In the latter case, the intermediate suspension parts can make connections between elements of the same hierarchical level or of a different level.

The result of the foregoing is that the suspension system or mechanism employed may be arranged both underneath the suspended support flat, in this case with an unstable equilibrium, see particularly FIGS. 9 to 16, and laterally, that is to say on the side of the actual support laths, in this case with a neutral equilibrium, as described above (see FIGS. 1 to 8), as well as arranged above the support flat, in this case bringing about a situation with a stable equilibrium (see FIG. 32), each time, of course, in one or more assembly planes.

Figure 32:
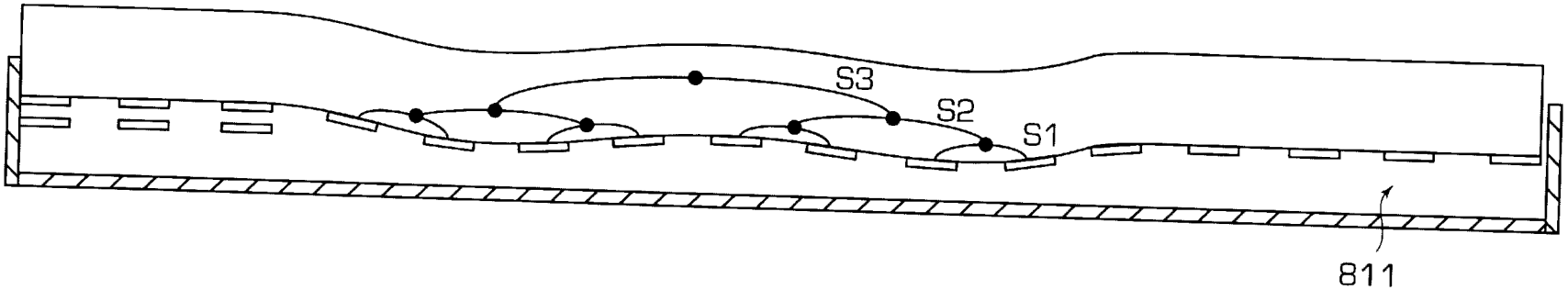
Figure 33:
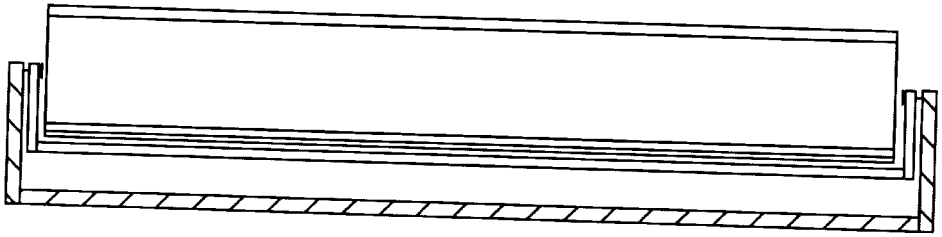

It goes without saying that the protection of the present invention is in no way limited to the alternative embodiments described above, but that the scope of these may embrace all the variants contained within the scope of the following claims. First, in a particular arrangement, a large-surface support flat 811 may be provided as a bed element, as shown in FIG. 32. A particular alternative embodiment is illustrated in FIG. 29, in which may be seen supporting means of somewhat compact shape, for example polygonal, in particular hexagonal, forming a honeycomb structure. The supporting means are likewise made interdependent relative to one another, as in the variants described above, with the hierarchical articulation connections illustrated in FIGS. 30 and 31, which are arranged in a similar way to the alternative embodiments described above. This results in a multi-dimensional undulatory effect by virtue of the special structure of the supporting elements 803 which, strictly speaking, do not have any inherent orientation. A support flat 811 of this type is most particularly suitable in the case of a bed which allows relaxation in all directions.

Figure 34:
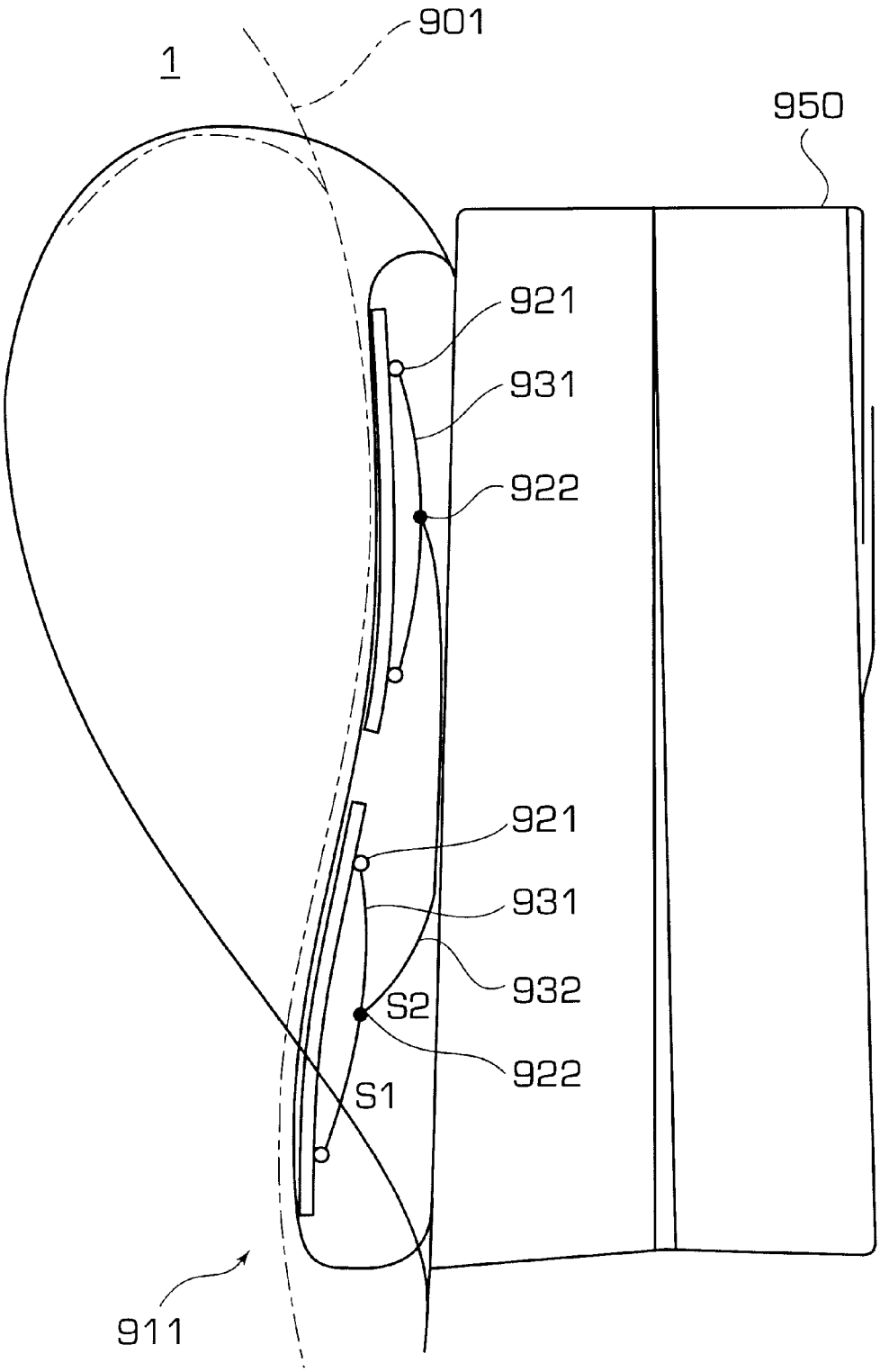
FIG. 34 shows yet another category of comfort device according to the invention.
Figure 35:
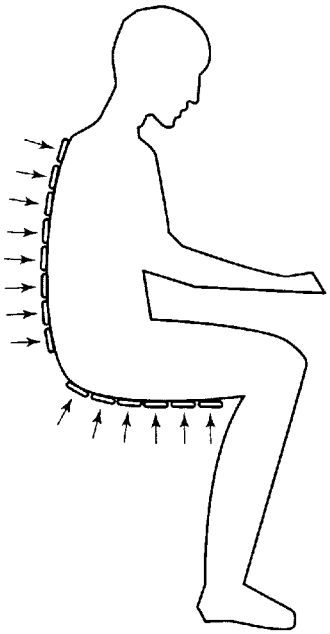
FIGS. 35–38 show the amplitude of forces for various support elements.
Figure 36:
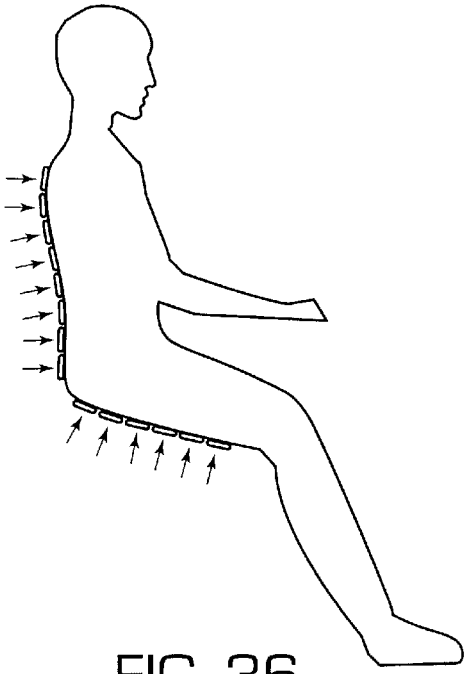
Figure 37:
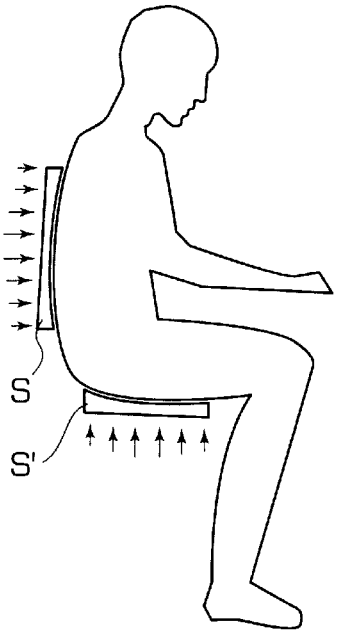
Figure 38:
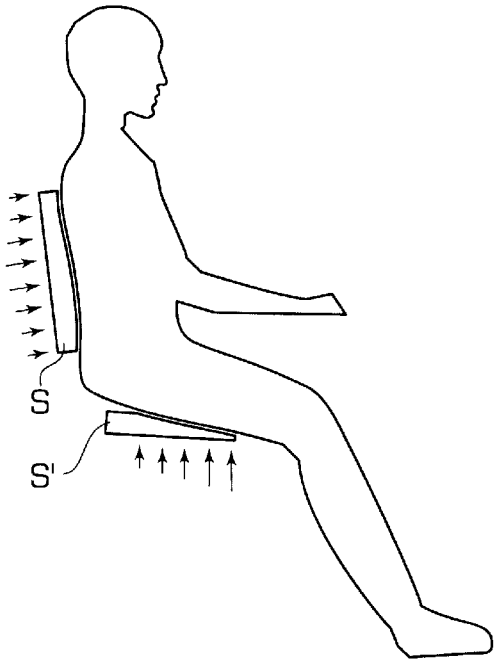
Figure 39:
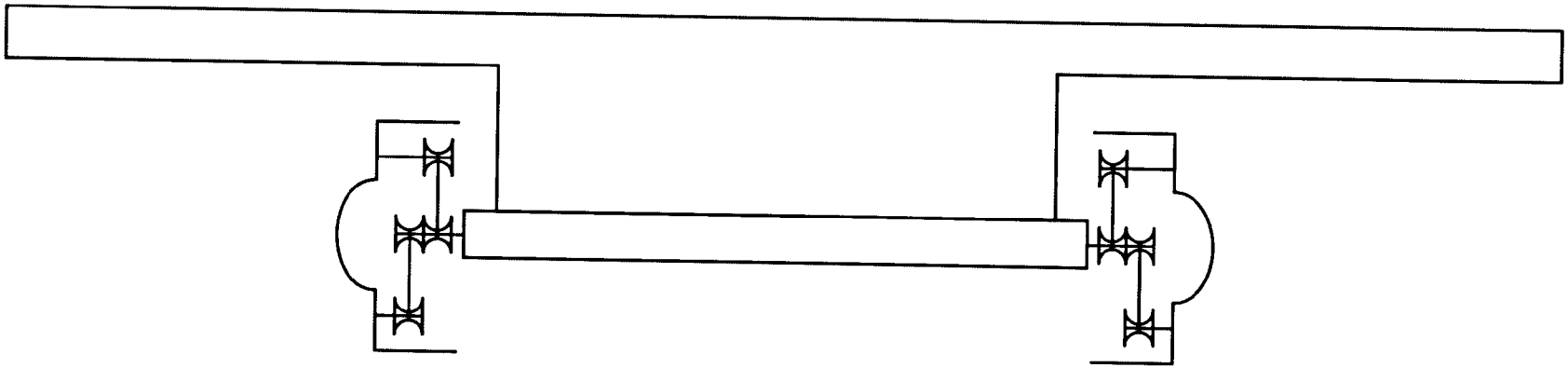
FIGS. 39–44 show the alternative embodiments of the invention.
Figure 40:
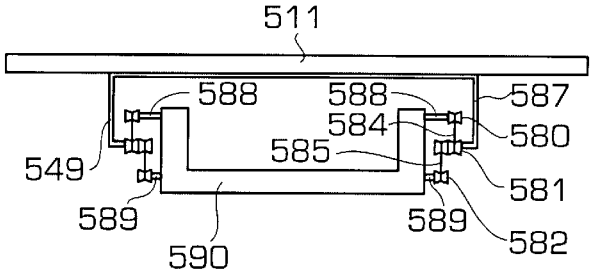
Figure 42:
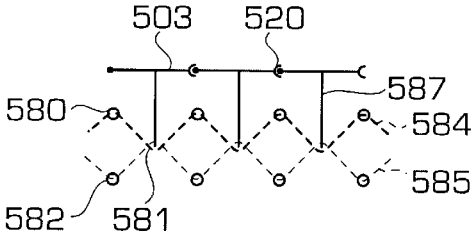
Figure 41:
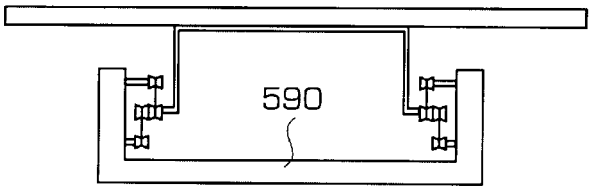
Figure 43:
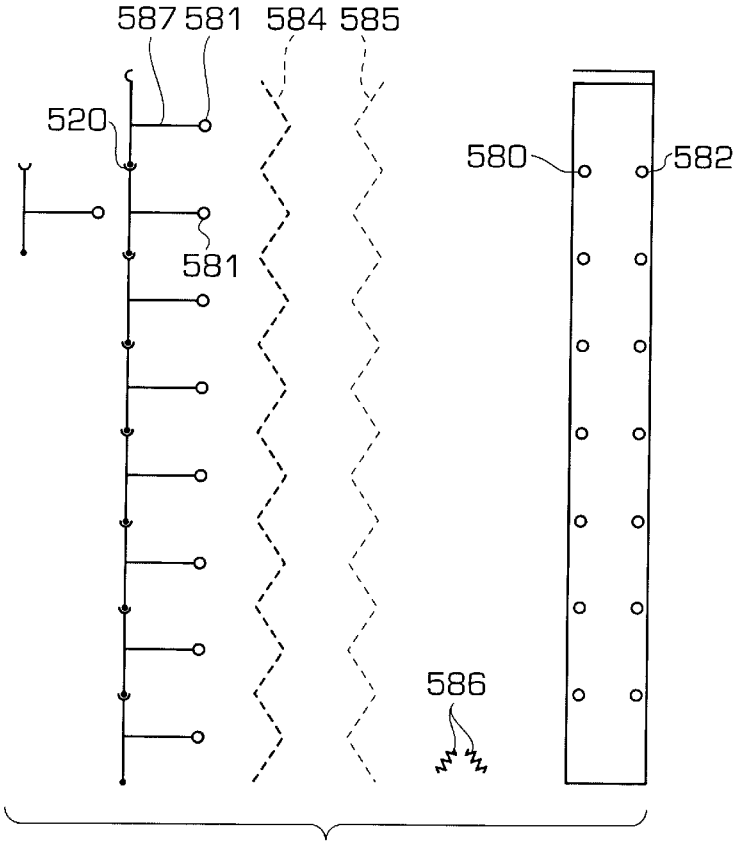
Figure 44:
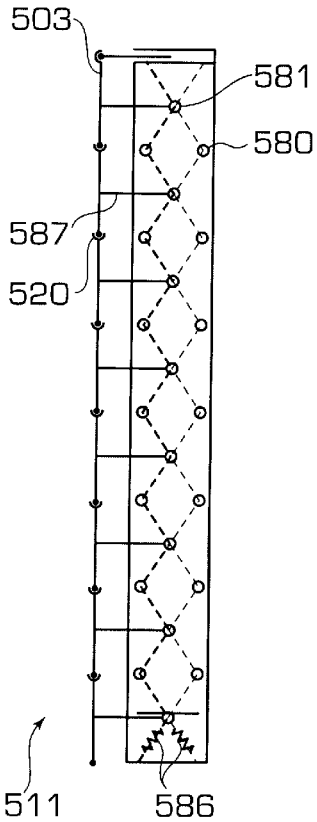

Yet another variant is illustrated in FIG. 34. It shows a support flat 911 arranged as a buffer interface between the back 901 of a pupil 1 and any satchel or baggage 950, particularly made of hardened synthetic material. In this case too, with the advent of more bulky satchels with a harder surface and of baggage of the same type, a means of interface with the back which must carry it becomes virtually indispensable if back ailments are to be avoided, particularly for children who are still growing rapidly. Good distribution of the pressure of the satchel, which may be loaded very unequally inside, proves highly expedient and makes it possible to contribute effectively to preventing the occurrence of scoliosis in particular.

I claim:

1. A body comfort device for furniture, in particular for seat or relaxing furniture, comprising; a frame having opposite sides, body support flats substantially in a same plane, each of said body support flats having at least one pair of elongate supporting elements on opposite sides of said body support flats, said elongate supporting elements being arranged parallel to each other and substantially perpendicularly oriented to longitudinal inner sides of said frame, N sets of intermediate suspension elements, each intermediate suspension element of a first set (I=1) of said set being connected by a first intermediate articulation connection to at least two elongate supporting elements, each intermediate suspension element of an $N^{th}$ set of said sets (I=N) connecting at least two intermediate suspension elements of an $(N-1)^{th}$ set to said frame by a second articulation connection, each intermediate suspension element of an $i^{th}$ set ($1<i<N$) connecting at least two intermediate suspension elements of an $(I-1)^{th}$ set to an intermediate suspension element of an $(I+1)^{th}$ set.

2. A body comfort device according to claim 1, wherein the first intermediate articulation connection articulates the intermediate suspension elements to one another and the elongate supporting elements, said first intermediate articulation connection consists of shafts which are all oriented in the direction of a longitudinal axis of the elongate supporting elements such that the elongate supporting elements are oriented by pivoting on their longitudinal axis when subjected to stress by the load of a user's body.

3. A body comfort device according to claim 1, further comprising a multiple-action suspension system having a pair of cables intersecting one another and cooperating with rollers, each roller forming a pulley and provided with a peripheral groove for the passage of said cables, and wherein each elongate supporting element is fastened to at least one double wheel, along which said cables intersect, and said rollers are fastened in pairs to said frame 50, that they are arranged alternately with the first rollers in a diamond-shaped configuration, such that said cables extend over the entire length of said body support flats at the same time zigzagging relative to each other.

4. A body comfort device according to claim 3, wherein said double rollers can rotate individually relative to one another or in a mutually integral manner on a common rotary shaft.

5. A body comfort device according to claim 3, wherein said elongate supporting elements of each body support flat is tensioned between the two cables, each of the cables acting as a pressure receiver in the event of load on the body support flat, and each other cable acting as a traction element, pulling each corresponding support flat against said frame.

6. A body comfort device according to claim 3, wherein each cable can be clamped by clamping members to adjust the length of the said cables.

7. A body comfort device according to claim 1, wherein each body support flat is one-piece including said elongate supporting elements and said intermediate suspension elements.

8. A body comfort device according to claim 7, wherein said body support flats are produced by injection moulding from synthetic material.

9. A body comfort device for furniture according to claim 1, wherein said elongate supporting elements and said intermediate suspension elements are formed as a one-piece member, said articulation connections being formed by linking members, thereby enabling an injection moulding of the one-piece member.

10. A body comfort device for furniture according to claim 1, wherein each said intermediate suspension element of one $i^{th}$ first set (i=1) comprises two T-shaped elements fitting in a central horizontal part of an H-shaped element, forming a second intermediate suspension element (i=2), said $N^{th}$ element (N=3) being formed by a sub-frame to which at least one H-shaped element is connected.

11. A body comfort device for furniture according to claim 1, wherein said intermediate suspension elements bend and successive sets of intermediates suspension elements are connected by a pivot.

12. A body comfort device for furniture according to claim 1, wherein said articulation connections, are provided for enabling articulation of said intermediate suspension elements with respect to each other and to said elongate supporting elements, each articulation connection being formed by an articulation shaft enabling the elongate supporting element to move by pivoting around its longitudinal axis.

13. A body comfort device according to claim 1, wherein said articulation connections between said elongate supporting elements are formed by at least one cable passing through said elongate supporting elements.

14. A body comfort device according to claim 1, wherein said articulation connection connecting the first to the $N^{th}$ (N=2) sets of intermediate suspension elements are formed by cables, the first set of intermediate suspension elements being formed by twin rollers, said twin rollers connected by means of said cables the first set of intermediate suspension elements to an $N^{th}$ set of intermediate suspension elements, the $N^{th}$ set being formed by two rollers applied at a predetermined distance to each other and along lateral sides of the frame.

* * * * *